US009180505B2

(12) United States Patent
Imanari et al.

(10) Patent No.: US 9,180,505 B2
(45) Date of Patent: Nov. 10, 2015

(54) WATER INJECTION CONTROLLER, WATER INJECTION CONTROL METHOD, AND WATER INJECTION CONTROL PROGRAM FOR ROLLING LINES

(75) Inventors: Hiroyuki Imanari, Minato-ku (JP); Mirei Kihara, Minato-ku (JP)

(73) Assignee: TOSHIBA MITSUBISHI-ELECTRIC INDUSTRAL SYSTEMS CORPORATION, Tokyo (JP)

( * ) Notice: Subject to any disclaimer, the term of this patent is extended or adjusted under 35 U.S.C. 154(b) by 650 days.

(21) Appl. No.: 13/575,656

(22) PCT Filed: Jan. 29, 2010

(86) PCT No.: PCT/JP2010/051269

§ 371 (c)(1),
(2), (4) Date: Jul. 27, 2012

(87) PCT Pub. No.: WO2011/092851

PCT Pub. Date: Aug. 4, 2011

(65) Prior Publication Data

US 2012/0298224 A1 Nov. 29, 2012

(51) Int. Cl.
*G05D 9/00* (2006.01)
*G05D 15/00* (2006.01)
(Continued)

(52) U.S. Cl.
CPC ..... *B21B 37/74* (2013.01); *B21B 45/0218* (2013.01); *Y10T 137/8158* (2015.04)

(58) Field of Classification Search
CPC ..... B21B 37/74; B21B 45/0218
USPC ..... 700/281, 282
See application file for complete search history.

(56) References Cited

U.S. PATENT DOCUMENTS 4,720,310 A * 1/1988 Viannay et al. ..... 148/503
4,813,652 A * 3/1989 Viannay et al. ..... 266/80
(Continued)

FOREIGN PATENT DOCUMENTS

CN 2860648 Y 1/2007
GB 479383 2/1938
(Continued)

OTHER PUBLICATIONS

Sekiguchi et al., "Temperature Control of Hot Strip Finishing Mill with Inter Stand Cooling", abstract 2004, 1 page.*
(Continued)

*Primary Examiner* — Robert Fennema
*Assistant Examiner* — Thomas Stevens
(74) *Attorney, Agent, or Firm* — Oblon, McClelland, Maier & Neustadt, L.L.P.

(57) ABSTRACT

A water injection controller and method usable in rolling lines using stored cooling water to cool a material. A cooling water usage predictor predicts, for a respective prescribed prediction cycle, usage of cooling water in a prescribed prediction target period. A constrained running condition predictor takes the predicted cooling water usage to predict a required running condition of a pump system in the prediction target period meeting a prescribed constraint condition. An energy consumption calculator takes the predicted running condition of the pump system to calculate an energy quantity to be consumed. An optimizer determines an optimal energy quantity to be consumed among plural energy quantities to be consumed under changed running conditions of the pump system. A pump system running controller controls running of the pump system having as a target value therefor a running condition of the pump system requiring the optimal quantity of energy to be consumed.

10 Claims, 14 Drawing Sheets

(51) Int. Cl.

| | |
|---|---|
| ***B21B 37/74*** | (2006.01) |
| *B21B 45/02* | (2006.01) |

(56) References Cited

U.S. PATENT DOCUMENTS

| | | | | |
|---|---|---|---|---|
| 5,412,528 | A * | 5/1995 | Mader et al. | 361/62 |
| 5,493,996 | A * | 2/1996 | Verschuere et al. | 119/460 |
| 5,534,155 | A * | 7/1996 | Schimion et al. | 210/695 |
| 5,950,643 | A * | 9/1999 | Miyazaki et al. | 134/25.4 |
| 2003/0063978 | A1 | 4/2003 | Takahashi et al. | |
| 2004/0244886 | A1* | 12/2004 | Tsuyama et al. | 148/661 |
| 2007/0119394 | A1* | 5/2007 | Leone | 123/25 R |
| 2009/0120465 | A1* | 5/2009 | Peukert et al. | 134/30 |
| 2009/0199935 | A1* | 8/2009 | Sakakura et al. | 148/541 |
| 2010/0224136 | A1* | 9/2010 | Papadoyianis et al. | 119/223 |
| 2010/0242490 | A1* | 9/2010 | Symonds | 60/775 |
| 2010/0269854 | A1* | 10/2010 | Barbieri et al. | 134/3 |
| 2011/0061703 | A1* | 3/2011 | Imanari | 136/205 |
| 2011/0265916 | A1* | 11/2011 | Oishi | 148/501 |
| 2014/0083051 | A1* | 3/2014 | Mielnik et al. | 53/426 |

FOREIGN PATENT DOCUMENTS

| | | |
|---|---|---|
| JP | 59-56516 | 4/1984 |
| JP | 60-84110 | 5/1985 |
| JP | 60-84110 U | 6/1985 |
| JP | 62 49126 | 10/1987 |
| JP | 63 13851 | 4/1988 |
| JP | 63 235013 | 9/1988 |
| JP | 2003-106731 A | 4/2003 |
| JP | 2004 34122 | 2/2004 |
| JP | 2005 297015 | 10/2005 |
| JP | 2007 268540 | 10/2007 |

OTHER PUBLICATIONS

Taiwanese Office Action issued Mar. 14, 2014, in Taiwan Patent Application No. 099108375, 3 pages.

International Search Report Issued Apr. 27, 2010 in PCT/JP10/51269 Filed Jan. 29, 2010, 2 pages.

Combined Chinese Office Action and Search Report issued December 30, 2013, in Chinese Patent Application No. 201080062555.9 with English translation of category of cited documents, 6 pages.

* cited by examiner

WATER INJECTION CONTROLLER, WATER INJECTION CONTROL METHOD, AND WATER INJECTION CONTROL PROGRAM FOR ROLLING LINES

FIELD

Embodiments described herein generally relate to a water injection controller, a water injection control method, and a water injection control program for rolling lines adapted to use cooling water stored in a tank for cooling a rolling material (including rolling rolls) in a rolling line, and collect cooling water after use, returning to the tank by a pump system.

BACKGROUND

As rolling lines for rolling metallic materials to make rolled materials, there are steel sheet manufacturing hot sheet rolling lines, plate rolling lines, and cold rolling lines, aluminum or copper rolling lines, etc. Among them, hot sheet rolling lines, plate rolling lines, and the like have a function of directly pouring water to a rolling material to control temperatures of the rolling material itself. All rolling lines have a function of cooling rolling rolls and the like working for a rolling material to be rolled thereon. Cooling water to be directly poured to a rolling material itself like the former case is called direct cooling water. Cooling water to be poured to rolling rolls and the like working for a rolling material to be rolled thereon is called indirect cooling water. They are collectively referred to as cooling water.

In particular, hot sheet rolling lines as well as plate rolling lines serving to roll a rolling material having as high temperatures as 1,000 degrees C. or near need a great deal of direct cooling water for the cooling. Further, there is needed a plenty of indirect cooling water for cooling rolling rolls contacting the high-temperature material.

For such reasons, there have been techniques proposed for cooling systems in rolling lines, including e.g. controlling valves in a cooling system to adjust cooling water flow rates or the like (refer to e.g. PTLs 1 to 3 below).

CITATION LIST

Patent Literature

PTL 1: JP 2007-268540 A
PTL 2: JP 2005-297015 A
PTL 3: JP 2004-034122 A

SUMMARY

Problem

By the way, generally, cooling systems in rolling lines might have posed a problem for cooling a rolling material if the quantity of cooling water stored in a cooling water tank were insufficient. For this reason, they employ one or more pumps for collecting cooling water used for cooling a rolling material, to return to the tank, always retaining the tank in an overflow state to keep the quantity of water in the tank at a constant level.

On the other hand, cooling water being returned to the tank through a pump system, as well as cooling water overflowing at the tank, is not in any service for cooling a rolling material. Therefore, the quantity of water in the tank may be controlled as necessary to reduce the amount of overflowing cooling water, successfully leading to an energy saving at the pump system to be operated to return cooling water to the tank.

In the techniques mentioned above in the background, disclosed techniques included controlling valves or the like to adjust flow rates or such of cooling water for cooling a rolling material or the like. However, there was no disclosure covering controls at a water injection controller for returning used cooling water to a tank.

As a result, there was the need of leaving a sufficient number of pumps as they were always driven to make a capacity control of cooling water at the tank in an overflowing manner, using electric power or the like in vain, as a problem.

Moreover, there may be a method of providing a water level gauge in the tank, as well. In this case, the water level gauge is to have a measured value fed back for a control to adjust the number of pumps, in order for the level of cooling water to be kept as necessary. However, when the value indicated on the water level gauge is a value at an uppermost level, it is difficult to determine whether cooling water is being used for a cooling or overflowing to have the value retained at the uppermost level, there being the need for a water level gauge or the like to be installed anew in the tank, as a problem. Further, when the level of cooling water is lowered, if any pump is driven rapidly, an electric motor driving the pump needs large power, constituting an inefficient matter, as another problem.

Embodiments described herein have been devised in view of the foregoing problems. It therefore is an object of embodiments to provide a water injection controller, a water injection control method, and a water injection control program for rolling lines adapted for an efficient operation of a pump system to inject cooling water to a tank, with a secured constraint condition on a rolling line.

Solution

To achieve the object, according to a first aspect of embodiments of the water injection controller for rolling lines, there is provided a water injection controller for rolling lines adapted to use cooling water stored in a tank to cool a rolling material in a rolling line and collect used cooling water to return to the tank by a pump system. This water injection controller for rolling lines includes a cooling water usage predictor, a constrained running condition predictor, an energy consumption calculator, an optimizer, and a pump system running controller. The cooling water usage predictor takes information pertinent to cooling the rolling material as a basis to predict, for a respective prescribed prediction cycle T1, a usage of cooling water in a prescribed prediction target period T2. The constrained running condition predictor takes the usage of cooling water predicted by the cooling water usage predictor as a basis to predict, for the respective prescribed prediction cycle T1, a running condition of the pump system in the prediction target period T2 meeting a prescribed constraint condition. The energy consumption calculator takes the running condition of the pump system as a basis to calculate a quantity of energy to be consumed for an operation of the pump system in the prediction target period T2. The optimizer operates, for the respective prescribed prediction cycle T1, to change the running condition of the pump system predicted by the constrained running condition predictor, to give to the energy consumption calculator, to have the energy consumption calculator calculate a plurality of quantities of energy to be consumed, and determine an optimal quantity of energy to be consumed among the plurality of quantities of energy to be consumed that the energy consumption calculator has calculated. The pump system running controller controls a running of the pump system having as a target value therefore a running condition of the pump system making the optimal quantity of energy to be consumed that the optimizer has determined.

Further, to achieve the object, according to a second aspect of embodiments of the water injection controller for rolling lines, the constrained running condition predictor includes a running condition predictor, and a running condition corrector. The running condition predictor takes the usage of cooling water predicted by the cooling water usage predictor as a basis to predict, for the respective prescribed prediction cycle T1, a running condition of the pump system in the prediction target period T2. The running condition corrector determines whether or not the prescribed constraint condition is met by the running condition of the pump system predicted by the running condition predictor, and operates simply when the constraint condition is unmet by the running condition of the pump system, to correct the running condition of the pump system meeting the constraint condition.

Further, to achieve the object, according to a third aspect of embodiments of the water injection controller for rolling lines, the above-noted water injection controller for rolling lines further includes a constraint condition monitor, and a target value corrector. The constraint condition monitor monitors in real time a quantity of state of the rolling line pertinent to the prescribed constraint condition. The constraint condition monitor monitors whether or not the prescribed constraint condition is unmet by the quantity of state of the rolling line. The target value corrector operates when the constraint condition monitor has determined the prescribed constraint condition as being unmet by the quantity of stall-, of the rolling line, to correct the target value of the pump system running controller to have a quantity of state of the rolling line residing within the prescribed constraint condition.

Further, to achieve the object, according to a fourth aspect of embodiments of the water injection controller for rolling lines, the cooling water usage predictor includes a direct usage predictor which inputs operational information on a used water quantity and time-dependent variations of cooling water for a current cooling rolling material as information pertinent to cooling the rolling material. The direct usage predictor takes the operational information as a basis to predict, for a respective prescribed prediction cycle T1, a usage of cooling water in a prescribed prediction target period T2.

Further, to achieve the object, according to a fifth aspect of embodiments of the water injection controller for rolling lines, the cooling water usage predictor includes an indirect usage predictor which stores therein a reference table including information on attributes of past cooled rolling materials associated with usages for the past cooled rolling materials. The indirect usage predictor inputs attribute information of a current cooling rolling material as information pertinent to cooling the rolling material. The indirect usage predictor takes the attribute information as a basis to refer to the reference table and predict, for a respective prescribed prediction cycle T1, a usage of cooling water in a prescribed prediction target period T2.

Further, to achieve the object, according to a sixth aspect of embodiments of the water injection controller for rolling lines, the cooling water usage predictor further includes a usage learner which inputs a usage of cooling water for a past cooled rolling material to perform a prescribed learning thereon. The usage learner uses the usage after the learning to update a usage for the past cooled rolling material in the reference table stored in the indirect usage predictor. And the indirect usage predictor inputs attribute information of the current cooling rolling material as information pertinent to cooling the rolling material. The indirect usage predictor takes the attribute information as a basis to refer to the reference table and predict, for a respective prescribed prediction cycle T1, a usage of cooling water in a prescribed prediction target period T2.

Further, to achieve the object, according to a seventh aspect of embodiments of the water injection controller for rolling lines, the cooling water usage predictor includes a direct usage predictor, an indirect usage predictor, and a usage learner. The direct usage predictor inputs operational information on a used water quantity and time-dependent variations of cooling water for a current cooling rolling material as information pertinent to cooling the rolling material, and takes the operational information as a basis to predict, for a respective prescribed prediction cycle T1, a usage of cooling water in a prescribed prediction target period T2. The indirect usage predictor stores therein a reference table including information on attributes of past cooled rolling materials associated with usages for the past cooled rolling materials, inputs attribute information of a current cooling rolling material as information pertinent to cooling the rolling material, and takes the attribute information as a basis to refer to the reference table and predict, for a respective prescribed prediction cycle T1, a usage of cooling water in a prescribed prediction target period T2. The usage learner inputs a usage of cooling water for a past cooled rolling material to perform a prescribed learning thereon, and uses the usage after the learning to update a usage for the past cooled rolling material in the reference table stored in the indirect usage predictor. And the cooling water usage predictor has the direct usage predictor or the indirect usage predictor predict a usage of cooling water in an adaptive manner depending on input information pertinent to cooling the rolling material.

Further, to achieve the object, according to an eighth aspect of embodiments of the water injection controller for rolling lines, the prescribed prediction cycle T1 and the prescribed prediction target period T2 have a relation in between such that $T1 \leq T2$.

Further, to achieve the object, according to a ninth aspect of embodiments of the water injection controller for rolling lines, the prescribed constraint condition includes one or more of upper and lower limit values of a water level or a retained water quantity in the tank, a minimal value in number of ruining ones of pumps constituting the pump system, and a minimal value of an output of electric motors running to drive pumps.

To achieve the object, according to an aspect of embodiments of the water injection control method for rolling lines, there is provided a water injection control method for rolling lines adapted to use cooling water stored in a tank to cool a rolling material in a rolling line and collect used cooling water to return to the tank by a pump system. This water injection control method for rolling lines includes a step of taking information pertinent to cooling the rolling material as a basis to predict, for a respective prescribed prediction cycle T1, a usage of cooling water in a prescribed prediction target period T2, a step of taking the predicted usage of cooling water as a basis to predict, for the respective prescribed prediction cycle T1, a running condition of the pump system in the prediction target period T2 meeting a prescribed constraint condition, a step of taking the predicted running condition of the pump system as a basis to calculate a quantity of energy to be consumed for an operation of the pump system in the prediction target period T2, a step of operating, for the respective prescribed prediction cycle T1, to change the predicted running condition of the pump system, to calculate a plurality of quantities of energy to be consumed, and determining an optimal quantity of energy to be consumed among the plurality of calculated quantities of energy to be consumed, and a step of having a running condition of the pump system making the optimal quantity of energy to be consumed as a target value to drive the pump.

To achieve the object, according to an aspect of embodiments of the water injection control program for rolling lines, there is provided a water injection control program for rolling lines to be executed by a computer in a course of using cooling water stored in a tank to cool a rolling material in a rolling line and collecting used cooling water to return to the tank by a pump system. This water injection control program for rolling lines includes, for the computer to execute, a step of taking information pertinent to cooling the rolling material as a basis to predict, for a respective prescribed prediction cycle T1, a usage of cooling water in a prescribed prediction target period T2, a step of taking the predicted usage of cooling water as a basis to predict, for the respective prescribed prediction cycle T1, a running condition of the pump system in the prediction target period T2 meeting a prescribed constraint condition, a step of taking the predicted running condition of the pump system as a basis to calculate a quantity of energy to be consumed for an operation of the pump system in the prediction target period T2, a step of operating, for the respective prescribed prediction cycle T1, to change the predicted running condition of the pump system, to calculate a plurality of quantities of energy to be consumed, and determining an optimal quantity of energy to be consumed among the plurality of calculated quantities of energy to be consumed, and a step of having a running condition of the pump system making the optimal quantity of energy to be consumed as a target value to drive the pump.

Advantageous Effects

As will be seen from the foregoing, according to embodiments herein, there is implemented taking information pertinent to cooling a rolling material in a rolling line as a basis to predict, for a respective prescribed prediction cycle T1, a usage of cooling water in a prescribed prediction target period T2. This is accompanied by predicting a running condition of a pump system meeting a prescribed constraint condition, to control a running of the pump system having as a target value therefore an optimal running condition of the pump system, such as that making a minimized quantity of energy to be consumed. As a result, the prescribed constraint condition is met, affording for the pump system to be operated efficient to return cooling water to a tank. This permits an energy saving as well as a cost saving to be directly promoted at the pump system working to return cooling water to the tank, allowing for a reduced environmental load at the rolling line.

DESCRIPTION OF EMBODIMENTS

Example 1

There will be described a water injection controller for rolling lines according to an example 1 of embodiment, with reference to the drawings. It is noted that the example described will be no more than one form of embodiments herein. These embodiments are in no way limited by that example, so the example can be changed as necessary.

Description is now made of an example of rolling line constituting an object to be cooled by using a water injection controller for rolling lines according embodiments herein.

Example of Rolling Line

Figure 1:
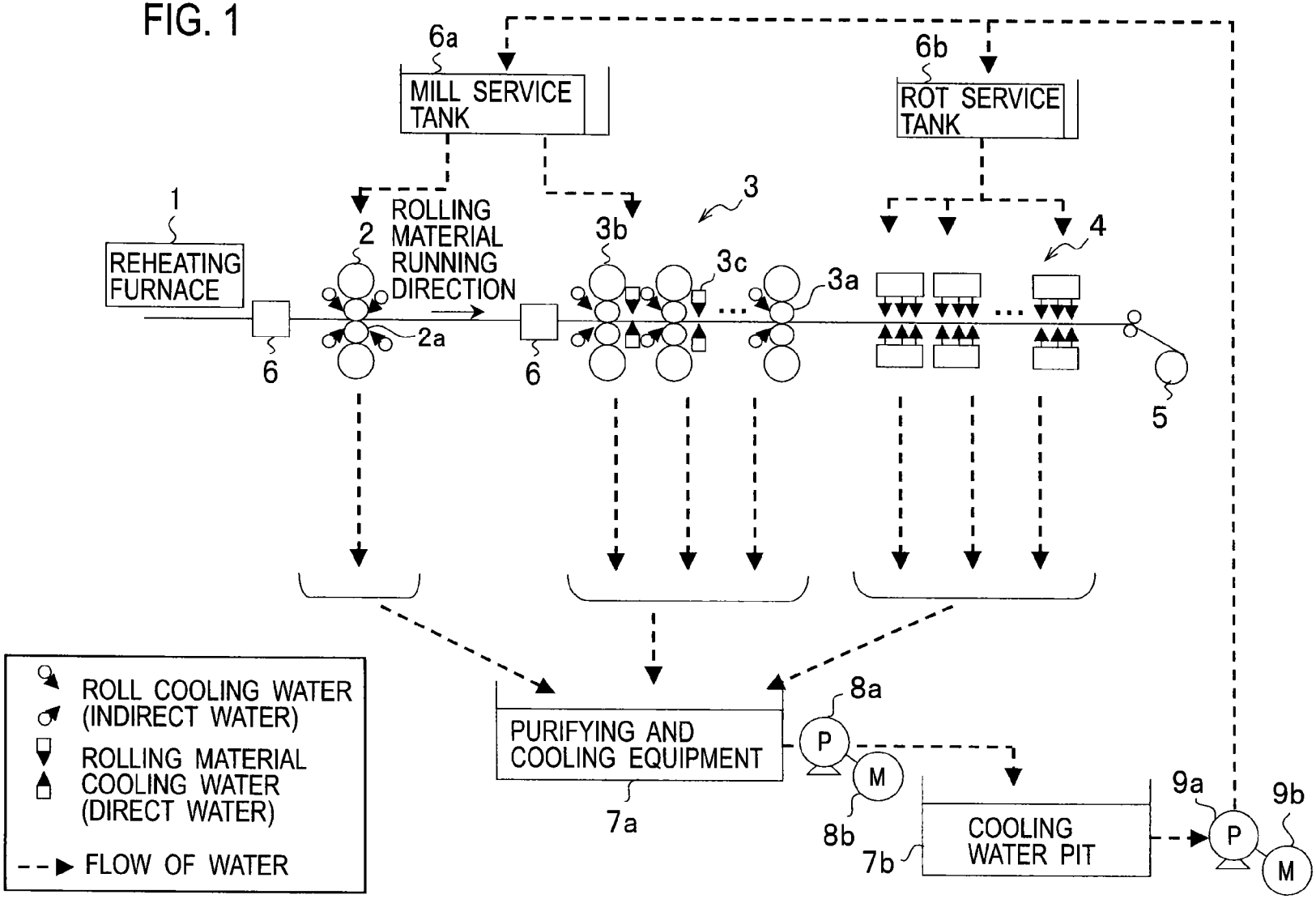
FIG. 1 is an explanatory diagram for explanation of circulations of cooling water and an outline of cooling water treatment facilities in a hot rolling line.

FIG. 1 shows in an explanatory diagram an outline of configuration of a hot sheet rolling line as an example of rolling line, and circulations of cooling water used there.

As for this example of embodiment, the rolling line to be described is an example of hot sheet rolling line. This example should however be construed as limiting no embodiments described herein. Accordingly, other rolling lines can also be targeted, including plate rolling lines as well as cold rolling lines, providing that they are of such a type that uses cooling water stored in a tank for cooling a rolling material in the rolling line, collecting used cooling water to return to the tank by a pump system.

First, description is made of an outline of configuration of the hot sheet rolling line.

The hot sheet rolling line shown in FIG. 1 has a rolling material such as a rectangular parallelepiped steel material referred to as a slab. This rolling material is heated to 1,200 degrees C. or near at a reheating furnace 1, and subjected to a number of passes of rolling at a roughing mill 2, to make a bar within a range of 30 to 40 mm or near in thickness. After that, the bar is rolled at a finishing mill 3, to a product within a range of 1.2 to 12 mm or near in thickness. After that, it is cooled on a run-out table (referred herein to as an ROT) 4 to have a coiling temperature within a range of 500 to 700 degrees-C. or near before a coiler 5. Finally, it is coiled as a product coil on the coiler 5. The rolling material called a slab thus has a changed name after a respective process in the rolling, such as a bar or coil. It is noted that the naming is now unified to a rolling material.

The hot sheet rolling line is made up by facilities being a reheating furnace 1, a roughing mill 2, a finishing mill 3, an ROT 4, and a coiler 5 in rough separation, as described. There are other facilities else than described, as a matter of course. However, for flows of cooling water to be considered, the objects concerned may not involve any more than those essential facilities.

Description is now made of flows of cooling water and the like to be used in the hot sheet rolling line.

As shown in FIG. 1, the roughing mill 2 and the finishing mill 3 use cooling water (indirect water) from a mill service tank 6*a* for cooling rolls 2*a* and 3*a* , respectively. Cooling water is used also at scale breakers 6 for removing oxide films on surfaces of a rolling material. Further, the finishing mill 3 has sprayers 3*c* installed therein for cooling a rolling material by spraying cooling water (direct water) thereto between roll stands 3*b*.

Further, a rolling material having exited a final roll stand 3*b* of the finishing mill 3 is transferred to the ROT 4. At the ROT 4, cooling water from an ROT service tank 6*b* is used for a control to have a desirable coiling temperature at the coiler 5.

Such being the case, cooling water stored in the mill service tank 6*a* and the ROT service tank 6*b* is used for cooling the rolls 2*a* and 3*a* , a rolling material, and the like.

Cooling water used for cooling the rolls 2*a* and 3*a* , a rolling material, and the like may contain iron dust, oil, dirt, etc., and have raised temperatures. Therefore, used cooling water is collected through pipes (un-depicted) or the like, excluding evaporated matters, and sent to purifying and cooling equipment 7*a* that implements known purifying and cooling processes. In this course, cooling water may be let through a cooling tower (un-depicted) or the like, as necessary to return to a normal temperature.

After that, used cooling water as collected is gathered from the purifying and cooling equipment 7*a* to a cooling water pit 7*b* by using a pump 8*a* driven by an electric motor 8*b*. This travel of cooling water is long, and takes a time. In addition, the purifying and cooling equipment 7*a* as well as the cooling tower (un-depicted) has a remarkably large capacity. For such reasons, it can be assumed that a sufficient amount of cooling water is supplied from the purifying and cooling equipment 7*a* to the cooling water pit 7*b*.

By the way, in the hot sheet rolling line, cooling water is most injected at the ROT 4. Hence, the ROT service tank 6*b* is dedicated for cooling water to be used at the ROT 4, and is provided independently of the mill service tank 6*a* as is in a typical case, as shown in FIG. 1.

It therefore is essential to aim at an optimization of a cooling water system about the ROT 4 in the course of examining an energy saving of the water injection controller for rolling lines. In this example of embodiment, there will be discussed an example of optimization for a cooling water system about the ROT 4. There may be similar discussions made also about the roughing mill 2, the finishing mill 3, or the scale breakers 6 being other than the ROT 4.

Figure 2:
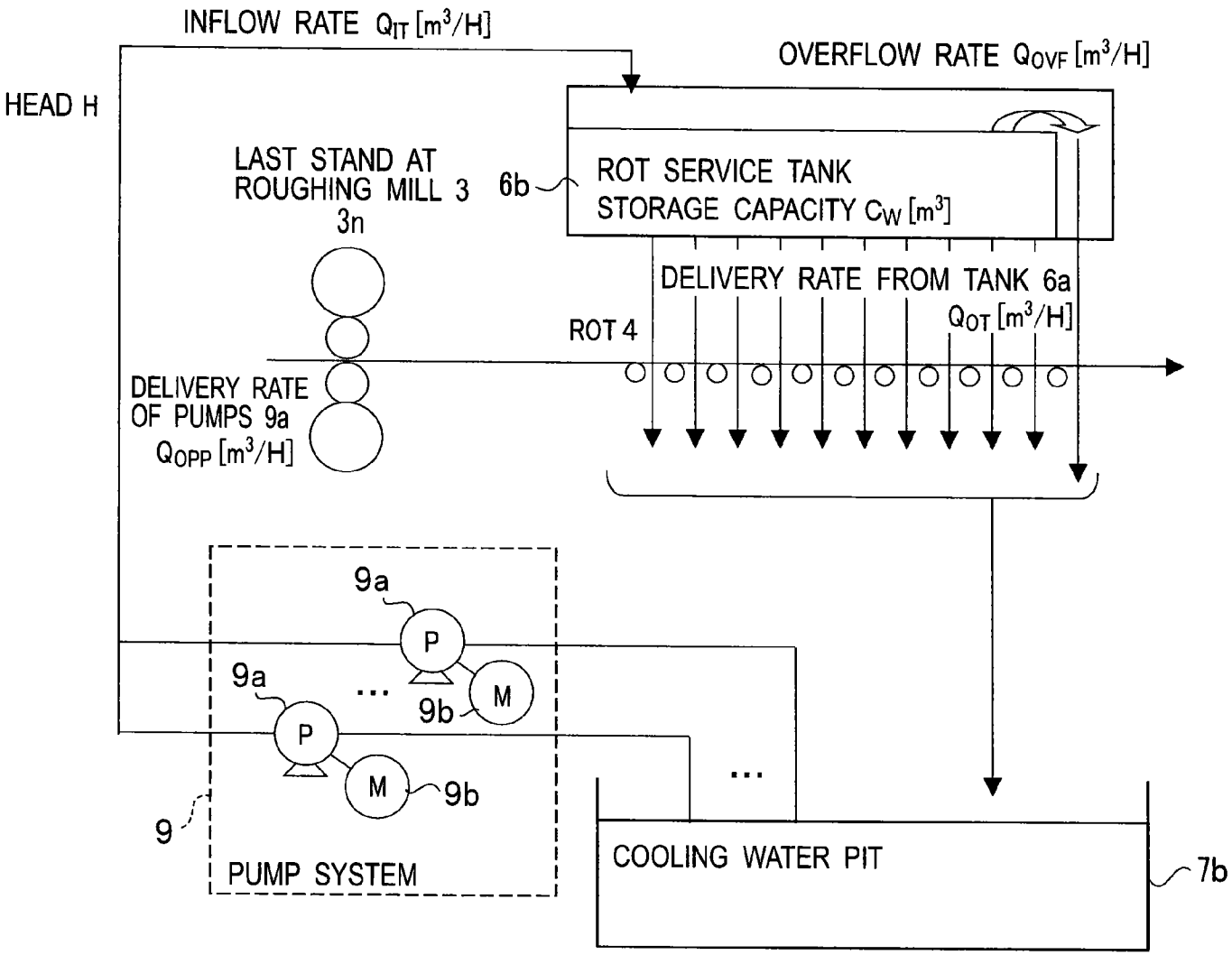
FIG. 2 is an explanatory diagram for explanation of a circulation of cooling water and an outline of a cooling water treatment facility at an ROT.

FIG. 2 shows in an explanatory diagram an outline of circulation of cooling water about the ROT shown in FIG. 1.

It is noted that the capacity of the purifying and cooling equipment 7*a* as well as that of the cooling tower (un-depicted) is very large. Further, between the purifying and cooling equipment 7*a* and the cooling water pit 7*b* there is little difference in level to be significant in consideration of loads on or power for the electric motor 8*b* to be operated to drive the pump 8*a*. Therefore, FIG. 2 is depicted omitting the purifying and cooling equipment 7*a* and the like.

In FIG. 2, for the ROT service tank 6*b* , designated at $C_W$ [$m^3$] is a stored volume of water, and $Q_{OVF}$ [$m^3$/h] is an overflow rate per unit time.

Further, for the ROT service tank 6*b* , designated at $Q_{IT}$ [$m^3$/h] is an inflow rate per unit time, and $Q_{OT}$ [$m^3$/h] is a delivery rate per unit time. These flow rates can be multiplied by a time to calculate a water inflow amount (as an injected water quantity) and a water delivery amount (as a used water quantity) of cooling water at the ROT service tank 6*b* , respectively.

Likewise, in FIG. 2, designated at $Q_{OPP}$ [$m^3$/h] is a delivery rate per unit time of pumps 9*a* . The delivery rate $Q_{OPP}$ [$m^3$/h] can be multiplied by a time to calculate a water delivery amount of cooling water of the pumps 9*a*.

As described with reference to FIG. 1 also, cooling water used at the ROT 4 is collected, and finally gathered at the cooling water pit 7*b* . Then, it is pumped from the cooling water pit 7*b* by using pumps 9*a* driven by electric motors 9*b* , to return to the ROT service tank 6*b* at an inflow rate $Q_{IT}$ [$m^3$/h]. After that, cooling water stored in the ROT service tank 6*b* is supplied as necessary at a delivery rate $Q_{OT}$ [$m^3$/h] to the ROT 4, where it is used for cooling a rolling material and the like. Used cooling water is again collected, and gathered at the cooling water pit 7*b* . Such a process sequence is repeated.

It is noted that in situations needing a large flow rate, pumps 9*a* are connected in parallel as illustrated in FIG. 2 to make a parallel run using electric motors 9*b* . Further, in situations needing a large head H, pumps 9*a* are connected in series to make a cascade run using electric motors 9*b* , though this is un-depicted.

Further, this example of embodiment has water injection facilities including the pumps 9*a* and electric motors 9*b* operable to return cooling water to the tank. They constitute a set of water injection facilities collectively referred to as a pump system 9.

<Configuration in Example 1>

Description is now made of a water injection controller 10 for rolling lines according to the example 1 of embodiment, with reference to the drawings. The hot sheet rolling line shown in FIGS. 1 and 2 constitutes an object of the description. It is noted that the description is applicable also to other forms of rolling line such as plate rolling lines and cold rolling lines, and aluminum or copper rolling lines.

Figure 3:
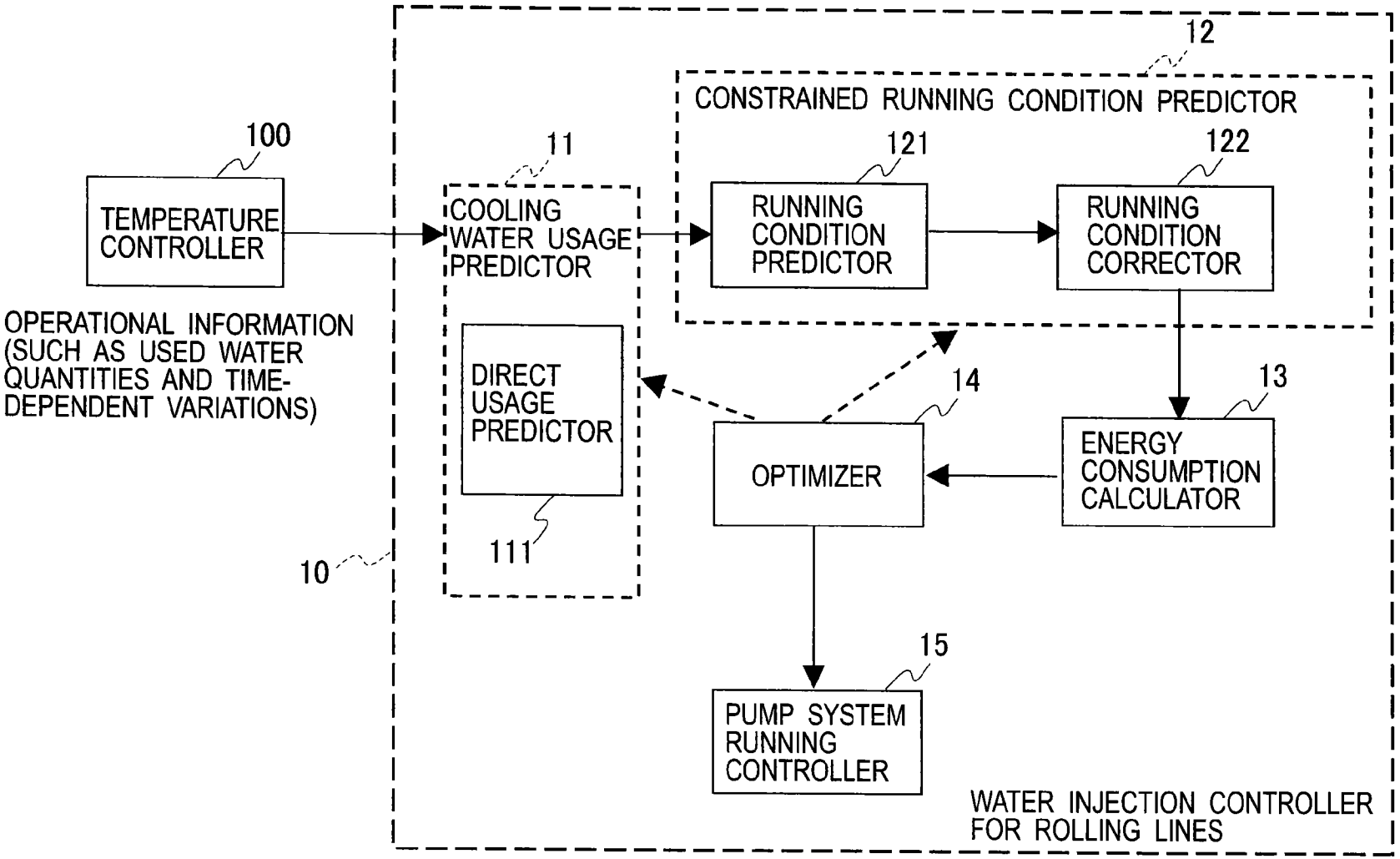
FIG. 3 is a block diagram showing an example of configuration of a water injection controller in a cooling line according to an example 1 of embodiment.

FIG. 3 shows in a block diagram an example of configuration of the water injection controller 10 for rolling lines according to the example 1 of embodiment, in combination with a temperature controller 100.

As shown in FIG. 3, according to this example of embodiment, the water injection controller 10 for rolling lines includes a cooling water usage predictor 11, a constrained running condition predictor 12, an energy consumption calculator 13, an optimizer 14, and a pump system running controller 15. This water injection controller 10 is configured to take information such as operational information on a cooling of a rolling material from the temperature controller 100, as a basis to control the pumps 9*a* and electric motors 9*b* constituting the pump system 9, to operate under an optimal running condition to return cooling water to the ROT service tank 6*b*.

Here, the cooling water usage predictor 11 is made as an implement for taking information pertinent to cooling a rolling material from the temperature controller 100 as a basis to predict, for each prescribed prediction cycle T1, a usage of cooling water to be used at the ROT 4 in a prescribed prediction target period 17. The cooling water usage predictor 11 includes a direct usage predictor 111.

The direct usage predictor 111 receives, as information pertinent to cooling a rolling material from the temperature controller 100, operational information (as direct information) on time-dependent variations such as those of e.g. an actual used water quantity per unit time (as an actual result) [$m^3$/h] of cooling water used for a rolling material being current cooled at the ROT 4, as well as a timing of its use and a duration of the use, as will be discussed later on. The direct usage predictor 111 takes the operational information (as direct information) as a basis to predict, for each prescribed prediction cycle T1, a usage of cooling water to be used at the ROT 4 in the prescribed prediction target period 17. That is, it predicts a progress of water injection to return cooling water to the ROT service tank 6*b*.

In other words, the cooling water usage predictor 11 may predict a state of use of cooling water including time-dependent variations such as those of e.g. a water delivery amount per unit time of cooling water to be delivered from the ROT service tank 6*b* in the prescribed prediction target period T2, as well as a timing of its use and a duration of the use. Or alternatively, the cooling water usage predictor 11 may predict a state of use of cooling water involving time-dependent variations such as those of e.g. a water inflow amount (as an injected water quantity) per unit time of cooling water to be returned by the pumps 9*a* to the ROT service tank 6*b* in the prescribed prediction target period T2, as well as a timing of its use and a duration of the use.

This is because one can use a delivery rate of cooling water from the ROT service tank 6*b* or an inflow rate of cooling water returned by the pump system 9 to the ROT service tank 6*b*, whichever is predicted, to determine the other with ease. This can be done assuming the delivery rate of cooling water from the ROT service tank 6*b* to be equivalent to an inflow rate of cooling water returned by the pump system to the tank, from the viewpoint of retaining a constant stored volume of cooling water at the ROT service tank 6*b* . That can be done even when assuming a relationship for the inflow rate of cooling water to the ROT service tank 6*b* to be kept equal to or greater than the delivery rate of cooling water from the ROT service tank 6*b* , in consideration of a little overflow from a safety perspective.

It is noted that the predicted usage of cooling water may well additionally include inclinations or change ratios of variations in durations of use of a water delivery amount or a water inflow amount (as an injected water quantity) per unit time of cooling water.

Further, the constrained running condition predictor 12 is made as an implement for taking the usage of cooling water predicted by the cooling water usage predictor 11 as a basis to predict, for each prescribed prediction cycle T1, a running condition of the pump system 9 in the prediction target period T2 meeting a prescribed constraint condition. Here, the constrained running condition predictor 12 includes a running condition predictor 121, and a running condition corrector 122.

The running condition predictor 121 is made as an implement for taking the usage of cooling water to be used at the ROT 4, as it is predicted by the cooling water usage predictor 11, as a basis to predict, for each prescribed prediction cycle T1, a running condition of the pump system 9 as necessary in the prediction target period T2. For instance, the running condition may include the number and output of electric motors 9*b* operated to drive one or more pumps 9*a* constituting the pump system 9.

The running condition corrector 122 is made as an implement for determining whether or not the prescribed constraint condition in the rolling line is met by the running condition of the pump system 9 predicted by the running condition predictor 121, and for operating simply when the constraint condition is unmet by the running condition of the pump system 9, to correct the running condition of the pump system 9, to meet the constraint condition. The prescribed constraint condition in the rolling line will be discussed later on.

In this example of embodiment, the constrained running condition predictor 12 is subdivided into the running condition predictor 121 and the running condition corrector 122, as described. It however is noted that, according to embodiments herein, the constrained running condition predictor 12 may not be subdivided into the running condition predictor 121 and the running condition corrector 122. The constrained running condition predictor 12 may well be adapted to take the usage of cooling water predicted by the cooling water usage predictor 11 as a basis to predict, for each prescribed prediction cycle T1, a running condition of the pump system 9 in the prediction target period T2 meeting the prescribed constraint condition.

The energy consumption calculator 13 is made as an implement for taking the running condition of the pump system 9 through the running condition corrector 122 as a basis to calculate, for each prescribed prediction cycle T1, a quantity of energy to be consumed as energy consumption at the pump system 9 in the prescribed prediction target period T2. For instance, the quantity of energy to be consumed may be calculated as necessary to implement an operation including the number of one or more pumps 9*a* constituting the pump system 9 as well as the number or output of electric motors 9*b* operated to drive the pumps 9*a*.

The optimizer 14 is made as an implement operable, for each prescribed prediction cycle T1, to change the running condition of the pump system 9 predicted by the running condition predictor 121 as described, to give through the running condition corrector 122 to the energy consumption calculator 13. This is done to have the energy consumption calculator 13 calculate a plurality of quantities of energy to be consumed. It is then operable, for each prescribed prediction cycle T1, to determine an optimal quantity of energy to be consumed, e.g. as a minimal quantity of energy to be consumed, among the plurality of quantities of energy calculated to be consumed.

The pump system running controller 15 is made as an implement for controlling a running of the pump system 9, having as a target value therefore an optimal running condition of the pump system 9 meeting the prescribed constraint condition that the optimizer 14 has determined.

It is noted that in this example of embodiment the temperature controller 100 is provided as a device for executing operations such as opening or closing delivery valves (undepicted) or the like at the ROT service tank 6*b* , to adjust a state of use of cooling water at the ROT 4, to control a temperature at the coiler 5 as a target. In this example 1 , the temperature controller 100 is thus adapted to have, as information pertinent to cooling a rolling material, such operational information as including time-dependent variations such as those of e.g. a used water quantity per unit time of cooling water used for a rolling material being current cooled at the ROT 4, as well as a timing of its use and a duration of the use. This information is output to the water injection controller 10 according to the example 1 . It is noted that in situations affording to take the temperature at the coiler 5 as a basis to predict a usage of cooling water varying with time at the ROT 4, the above operational information may not be limited to operational information including time-dependent variations such as those of a used water quantity per unit time of cooling water used for the rolling material being current cooled at the ROT 4, as well as a timing of its use and a duration of the use, but may cover other operational information else.

<Operations in Example 1>

Description is now made of operations of the water injection controller 10 for rolling lines configured as described according to the example 1 of embodiment, with reference to flowcharts.

Figure 4A:
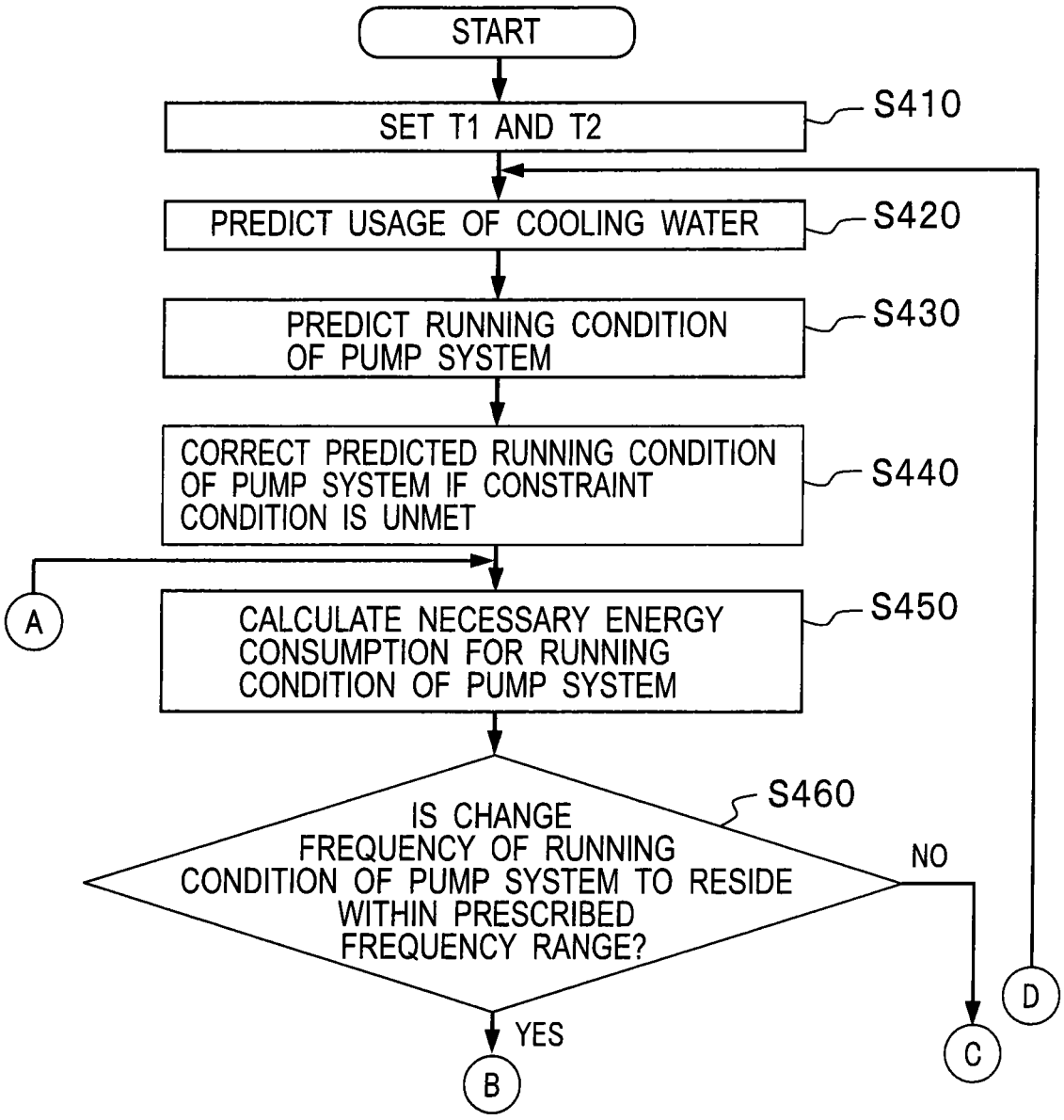
FIG. 4A is a flowchart showing part of an example of sequence of operations of the water injection controller in the cooling line according to the example 1 of embodiment.
Figure 4B:
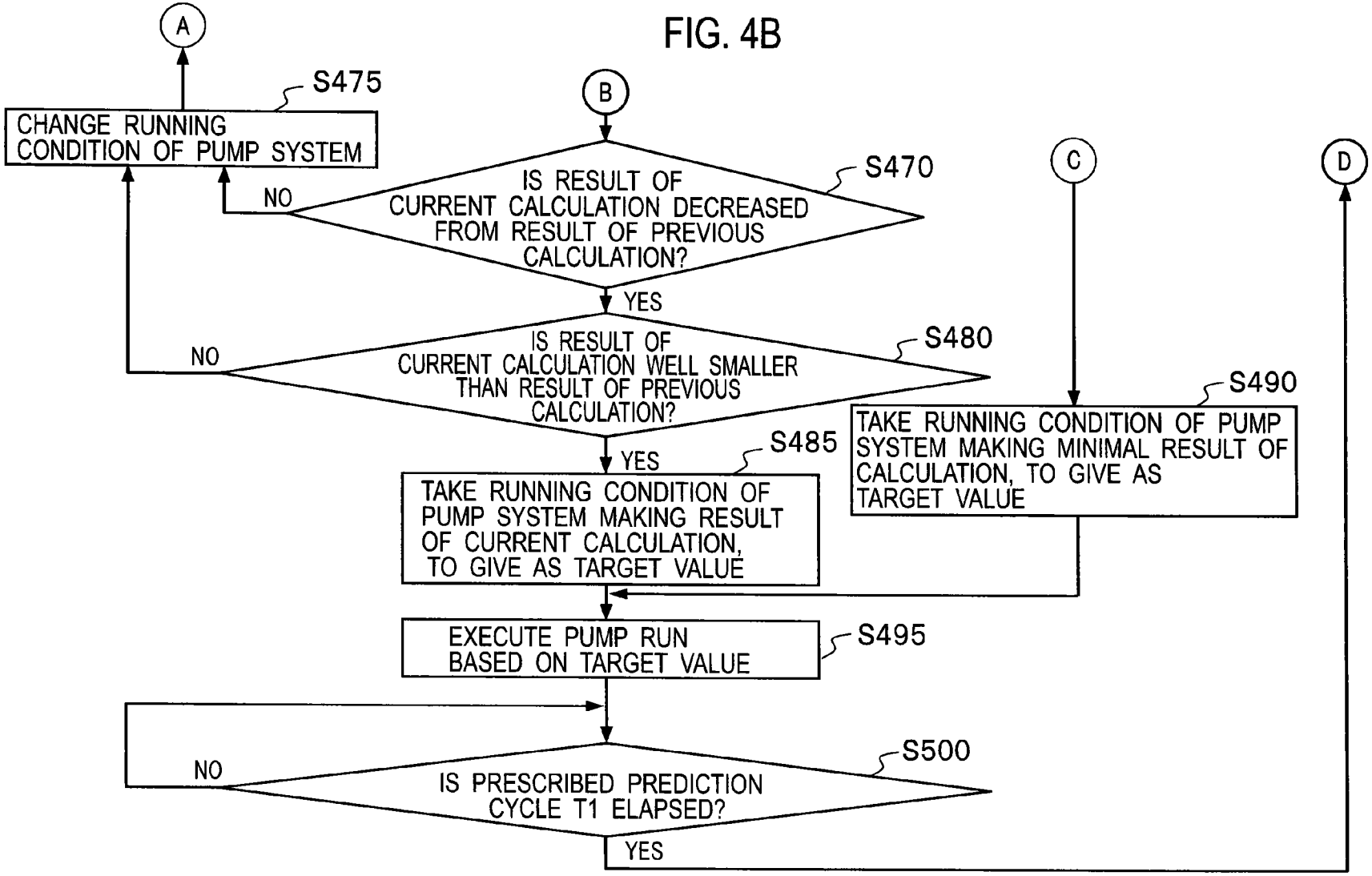
FIG. 4B is a flowchart showing part of the example of sequence of operations of the water injection controller in the cooling line according to the example 1 of embodiment.

FIG. 4A and FIG. 4B constitute a flowchart showing an example of sequence of operations of the water injection controller 10 for rolling lines according to the example 1.

According to the example 1 , the water injection controller 10 for rolling lines repeats, for each prescribed prediction cycle T1, a processing comprised of steps 420 to 500 as shown in FIG. 4A and FIG. 4B.

(1) Setting Prescribed Prediction Cycles T1 and Prescribed Prediction Target Periods T2 (At a Step 410):

First, (at the step 410) the optimizer 14 executes settings of prescribed prediction cycles T1 and prescribed prediction target periods T2 to the cooling water usage predictor 11, as well as to the running condition predictor 121 and the like.

It is noted that for prescribed prediction cycles T1 and prescribed prediction target periods T2 being fixed in value, the cooling water usage predictor 11 as well as the running condition predictor 121 and the like may have their values set up in advance leaving out the step 410 as a process to be skipped. Further, instead of adapting the optimizer 14 alone, other components such as the cooling water usage predictor 11 and the running condition predictor 121 may well be adapted to execute individual settings.

Here, the term 'prescribed prediction cycle T1' means a time slot (or cycle) to repeat a prediction such as that of a used water quantity or a running condition. T1 may be set to e.g. 0.5 hours. Further, the term 'prescribed prediction target period T2' means a targeted period to make predictions such as those of used water quantities and/or running conditions. T2 may be set to e.g. 2 or 3 hours. It is noted that such values are examples, and in no way constitute limitations.

Further, the example 1 employs a prescribed prediction cycle T1 shifting a prediction target period T2. This prediction target period T2 has a relationship to the prediction cycle T1, such that T1≤T2. That is, the prediction target period T2 is made equal to or greater than the prescribed prediction cycle T1.

This is not simply because the setting T1≤T2 can eliminate any period free from prediction. But also because it can render the prediction target period T2 available as a longer prediction target period for predictions, permitting a calculation every prediction cycle T1 shorter than the prediction target period T2, thus allowing for an increased tendency to update a result of prediction using the latest information. It however is noted that when given a combination of a prediction cycle T1 and a prediction target period T2 according to embodiments herein, the prediction cycle T1 and the target period T2 may not be limited to the relationship T1≤T2, but may be T1≤T2. Further, neither of them may be fixed in value, but both of them may be adaptively variable values to be set.

It also is noted that any prescribed prediction cycle T1 and any prescribed prediction target period T2 may be a fixed value, or may be an adaptive variable value. In other words, for prescribed prediction cycles T1 and prescribed prediction target periods T2 to be set, their setting methods depend also on a combination of processing capacities of hardware such as those of computers, as well as on a combination of modes of rolling operations, as they are applied to implement embodiments herein. In this example of embodiment, an associated component that may be the optimizer 14 is adapted to select one of setting methods (i) to (iv) set forth below for instance.

(i) Prescribed prediction cycles T1 and prediction target periods T2 are set up as constant values.

(ii) Prescribed prediction cycles T1 are variable. As the direct image predictor 121 is started each time when information from the temperature controller 100 is updated, there is provided a combination of upper and lower limit values defining a range of prescribed prediction cycles T1, within which a prescribed prediction cycle T1 is set up. Prescribed prediction target periods T2 are set up as constant values.

(iii) Prescribed prediction cycles T1 are variable. As the direct usage predictor 121 is started each time when information from the temperature controller 100 is updated, there is provided a combination of upper and lower limit values defining a range of prescribed prediction cycles T1, within which a prescribed prediction cycle T1 is set up. Prescribed prediction target periods T2 also are variable. There is provided a combination of upper and lower limit values defining a range of prescribed prediction target periods T2, though changed depending on the magnitude of value of the prescribed prediction cycle T1. For a prescribed prediction target period T2 to be set, the setup is made within this range.

(iv) Prescribed prediction cycles T1 and prediction target periods T2 are variable. When the interval of rolling or the service interval of the water injection controller is long, prescribed prediction cycles T1 and prediction target periods T2 also are set long commensurately therewith. When the interval of rolling or the service interval of the water injection controller is short, prescribed prediction cycles T1 and prediction target periods T2 also are set short commensurately therewith. However, there are provided combinations of upper and lower limit values defining ranges of prescribed prediction cycles T1 and prediction target periods T2 respectively, within which a prescribed prediction cycle T1 and a prescribed prediction target period T2 are set up.

Description is now made of the reason why it is advantageous to make prescribed prediction cycles T1 variable. The direct usage predictor 111 has operational information such as a used water quantity updated and input thereto from the temperature controller 100 every after several control operations, so for instance the timing to input the operational information may be used to define a prescribed prediction cycle T1, instead of fixing the duration of the prescribed prediction cycle T1 to a constant value. In this regard, this example of embodiment has a prediction target period T2 shifted each time when inputting operational information such as a used water quantity, to make a prediction thereon. Accordingly, the prediction is always permitted to be executed as an optimal one based on operational information such as a latest used water quantity, this being the reason why.

Also, description is now made of the reason why it is advantageous to make prescribed prediction target periods T2 variable. When the interval of rolling or the service interval of the water injection controller is open wide, setting prescribed prediction target periods T2 to a small constant value may cause the calculation load in the prediction to be unnecessarily increased. Therefore, prescribed prediction target periods T2 are made variable in accordance with the interval of rolling or the service interval of the water injection controller, thereby allowing for a decreased calculation load in the prediction.

Further, description is now made of the reason why it also is advantageous to make prescribed prediction target periods T2 constant in value. In situations in which the capacity of computer available for prediction is limited, if prescribed prediction target periods T2 are made variable, the processing time for operations may be over-extended for the processing capacity to keep up with Such matters should be avoided, this being the reason why. It is noted that, in rolling lines directly coupled with a continuous casting installation, slabs are supplied at substantially constant intervals of time, so it gives little merit to make prescribed prediction cycles T1 or prescribed prediction target periods T2 variable. In such a case, prescribed prediction cycles T1 and prescribed prediction target periods T2 are fixed in value.

Such being the case, under various conditions, it becomes different how to select an optimal combination of a prescribed prediction cycle T1 and a prescribed prediction target period T2. To this point, associated components such as the optimizer 14 are adapted to select an optimal combination of a prescribed prediction cycle T1 and a prescribed prediction target period T2 based on given conditions that may vary. In the course of selection, when making a prescribed prediction cycle T1 or a prescribed prediction target period T2 variable, there may well be provided a combination of upper and lower limit values.

(2) Predicting a Usage (At a Step 420):

Next (at the step 420), the cooling water usage predictor 11 takes information pertinent to cooling a rolling material, as it is given from the temperature controller 100, as a basis to predict, for each prescribed prediction cycle T1, a usage of cooling water to be delivered from the ROT service tank 6*b* to use in a prescribed prediction target period T2.

Here, assuming no occurrences of overflow of cooling water at the ROT service tank 6*b* , predicting the usage of cooling water to be delivered from the ROT service tank 6*b* to use in the prescribed prediction target period T2 is identical to predicting a usage of cooling water to be injected by pumps 9*a* to the ROT service tank 6*b* in the prescribed prediction target period T2.

Here, the temperature controller 100 is working to control a temperature at the coiler 5 as a target, assuming a cooling at e.g. the ROT 4 shown in FIG. 1. Hence, the temperature controller 100 serves for operating delivery valves (un-depicted) or the like at the ROT service tank 6*b* to open and close, as necessary, to adjust a state of use of cooling water at the ROT 4, so that, on a temperature instrument (un-depicted) provided upstream of the coiler 5, the value of measurement reads a desirable target temperature. It is noted that, when controlling a temperature at the finishing mill 3 shown in FIG. 1 as a target, the temperature controller 100 serves to make adjustments of inter-stand cooling water in the finishing mill 3, as well as of the rolling speed, so that, on a temperature instrument (un-depicted) installed at a finish outlet end of the finishing mill 3, the value of measurement reads a desirable target temperature.

To this point, for this example of embodiment, the temperature controller 100 is described as governing a state of use of cooling water at the ROT 4 shown in FIG. 2, to control a temperature at the coiler 5 as a target, assuming an example of cooling at the ROT 4 for the sake of convenience in description.

Here, the temperature controller 100 is informed, in advance, of pieces of direct operational information such as in what used quantity per unit time, at which timing, and by what duration of time cooling water should be used for each of rolling materials to be brought in turn onto the ROT 4. The temperature controller 100 outputs such pieces of direct operational information, as information pertinent to cooling a rolling material, to the cooling water usage predictor 11.

It is now assumed for this example of embodiment that the temperature controller 100 is operable, for any rolling material identified as an object of cooling, to calculate a used water quantity several times, outputting each time a result of the calculation (as a prediction) of a state of use of cooling water to the cooling water usage predictor 11.

For instance, the temperature controller 100 may have a calculation (as a first calculation) made of a used water quantity of cooling water at the ROT 4 for a rolling material identified as a cooling object still residing in the reheating furnace 1 (refer to the FIG. 1). The temperature controller 100 may have another calculation (as a second calculation) made of a used water quantity of cooling water at the ROT 4 for the rolling material, as its temperatures are measured by temperature instruments (un-depicted) installed at an inlet end of the finishing mill 3 (refer to the FIG. 1). The temperature controller 100 may have still another calculation (as a third calculation) made of a used water quantity of cooling water at the ROT 4 for the rolling material, as it is bitten by a most upstream stand of the finishing mill 3 (refer to the FIG. 1). The temperature controller 100 may finally have yet another calculation (as a final calculation) made of a used water quantity of cooling water at the ROT 4 for the rolling material, as its temperatures are measured over the length by temperature instruments installed at an outlet end of the finishing mill 3, in the manner of taking the measured temperatures as a basis to determine a result The temperature controller 100 is adapted to calculate a used water quantity of cooling water at the ROT 4 to determine a result with an increased precision, as the number of times of calculation increases from the first calculation.

Therefore, in this example of embodiment, in situations in which operational information including a used water quantity of cooling water at the ROT 4 that the temperature controller 100 has calculated at each timing of calculation, as well as a time-dependent variation thereof is output from the temperature controller 100 every time when the calculation is made, the cooling water usage predictor 11 is operable to take pieces of operational information derived from a late time of calculation to be highest in precision, as a basis to predict a usage of cooling water at the ROT 4 in a prescribed prediction target period T2.

(3) Predicting a Running Condition of the Pump System 9 (At a Step 430):

Assume that the cooling water usage predictor 11 has predicted a usage of cooling water at the ROT 4 in the prescribed prediction target period T2 in a process at the step 420. Then (at the step 430), the running condition predictor 121 takes the usage of cooling water at the ROT 4 in the prescribed prediction target period T2, as it is predicted by the cooling water usage predictor 11, as a basis to predict a running condition of the pump system 9 as necessary in the prediction target period T2, and outputs a result of this prediction to the running condition corrector 122.

Here, the running condition of the pump system 9 means a set of contents including the number of pumps 9*a* required for water injection to the ROT service tank 6*b* , the number of electric motors 9*b* to be operated to run to drive the pumps 9*a* , and a running output (in terms of power consumption) of the electric motors 9*b*.

It is noted that the running condition predictor 121 is adapted to implement a method of predicting, for each prescribed prediction cycle T1, a running condition of the pump system 9 based on a usage of cooling water at the ROT 4 in a prescribed prediction target period T2. This prediction method will be discussed later on.

(4) Correcting a Running Condition of the Pump System 9 (At a Step 440):

Assume that the running condition predictor 121 has predicted a running condition of the pump system 9 based on the usage of cooling water at the ROT 4 in the prescribed prediction target period T2. Then (at the step 440), the running condition corrector 122 determines whether or not a prescribed constraint condition is met by the running condition of the pump system 9 predicted by the running condition predictor 121, and operates simply when the constraint condition is unmet by the running condition of the pump system 9, to correct the running condition of the pump system 9, meeting the constraint condition, to output to the energy consumption calculator 13.

This is because of varieties of constraint conditions imposed on the set of water injection facilities involving the pump system 9 including pumps 9*a* , as well as electric motors 9*b* for driving the umps 9*a* . In situations in which the constraint condition is unmet by the running condition of the pump system 9 predicted by the running condition predictor 121, there might be caused troubles such as those of water injection facilities or in water injection, unless the running condition of the pump system 9 is corrected to meet the constraint condition, this being a reason why.

Here, the constraint condition is a set of contents which may include, for instance, such a content of matter that the ROT service tank 6*b* should have a storage capacity or water level kept from getting lower than a lower limit value. This is because of the need to inject cooling water onto a rolling material with pressures retained over a certain level, when supplying the ROT 4 with cooling water from a higher level where the ROT service tank 6*b* is placed. In other words, the rolling material has surfaces ranging from several hundred degrees C. to one thousand degrees C. or near. When exposed to water injection, those surfaces have so-called films boiling formed thereon, behaving to obstruct the cooling. For the cooling capacity to be enhanced, it is necessary to break such films boiling by using pressures retained over a certain level. In order for pressures to be retained, the ROT service tank 6*b* should have a water level secured to a specified level or within a higher range, this being the reason why.

Further, the pumps 9*a* are required to have performances not simply for the delivery rate $Q_{OPP}$ [$m^3$/h], but also for the head H to pump cooling water to a place at a higher level, as shown in FIG. 2. In this respect, for the head H to be secured as necessary, the constraint condition may include, as its content, a minimal value of the number of pumps 9*a* to be driven or a minimal value of the output of electric motors 9*b* to be operated to drive pumps 9*a*.

Further, among the pumps 9*a* , if the driven pump number is reduced to a zero, associated pipes (un-depicted) as well as the pumps 9*a* have no cooling water remaining therein. This state may cause anxieties when restarting pumps 9*a* , such as those about idle running, and damages to or abnormal sounds occurring at pumps 9*a* or electric motors 9*b* . In this respect, the constraint condition may include, as its content, such a condition that at least e.g. one pump 9*a* should be always kept driven to ensure retained water in a pipeline (un-depicted) or pump.

The running condition corrector 122 is operable to take into account the constraint condition including such contents, to apply restrictions for the constraint condition including such contents not to be unmet by the running condition of the pump system 9 predicted for each prescribed prediction cycle T1 by the running condition predictor 121 as necessary in the prescribed prediction target period T2. If the constraint condition is unmet, the running condition corrector 122 operates to correct the running condition of the pump system 9 as necessary to meet the constraint condition.

On the other hand, unless the constraint condition is unmet by the running condition of the pump system 9 predicted by the running condition predictor 121, the running condition corrector 122 operates to output, to the energy consumption calculator 13, the running condition of the pump system 9 as it is predicted by the running condition predictor 121. This running condition involves a set of contents as necessary in the prescribed prediction target period T2, including the number of pumps 9*a* to be driven as well as a running output (as power consumption) of electric motors 9*b* to be operated to drive the pumps 9*a* , as they are uncorrected to output as they are.

It is noted that there may be a constrained running condition predictor 12 not subdivided into a running condition predictor 121 and a running condition corrector 122. This constrained running condition predictor 12 may then be adapted to take a usage of cooling water predicted by the cooling water usage predictor 11 as a basis to predict, for each prescribed prediction cycle T1, a running condition of the pump system 9 in a prediction target period T2 meeting a prescribed constraint condition. In this case, there may be executed a single step substituting for the combination of the step 430 being a process of predicting a running condition of the pump system and the step 440 being a process of correcting the running condition of the pump system.

(5) Selecting a Running Condition of the Pump System to Optimize a Quantity of Energy to be Consumed (At Steps 450 to 495):

After that, the energy consumption calculator 13 receives a running condition of the pump system 9 as it is input thereto as a result of prediction from the running condition predictor 121, through the running condition corrector 122, involving a set of contents as necessary in the prescribed prediction target period T2, including the number of pumps 9*a* to be driven as well as a running output (as power consumption) of electric motors 9*b* to be operated to chive the pumps 9*a* . Then (at the step 450), the energy consumption calculator 13 calculates a quantity of energy to be consumed in the prescribed prediction target period T2, as it is necessary to implement the running condition of the pump system 9 being the result of prediction, and outputs it to the optimizer 14.

Here, the energy consumption calculator 13 calculates the quantity of energy to be consumed as a quantity of energy consumed as it is given from the power supply end, that is, an electric energy to be supplied after considerations including such as those of efficiencies of electric motors 9*b* to be operated to drive pumps 9*a* as well as whether or not an inverter driving is possible.

Then (at a step 460), the optimizer 14 identifies a frequency of changes in the running condition of the pump system 9, to determine whether or not the change frequency of the running condition of the pump system 9 is to reside within a prescribed range of frequencies. It is noted that this change frequency can be set to an arbitrary number of times, such as five or ten, after considerations including such as those of the controller's processing capacity, and calculation capacity, as well as prescribed prediction cycles T1 and prediction target periods T2.

If the change frequency of the running condition of the pump system 9 is to exceed the prescribed frequency range ("YES" at the step 460), the optimizer 14 operates (at the step 490) to select an optimal, that is, a minimal quantity of energy to be consumed from among quantities of energy to be consumed, as they have been calculated till then by the energy consumption calculator 13 the optimizer 14 has controlled to do so by having changed running conditions of the pump system 9. The optimizer 14 selects the minimal quantity of energy to be consumed, to give as a target value to the pump system running controller 15.

On the contrary, when the change frequency of the running condition of the pump system 9 is to reside within the prescribed frequency range ("YES" at the step b 460), the optimizer 14 enters a sub-sequence of processes at steps 470 et seq. constituting a process for comparison between a current result of calculation of the quantity of energy to be consumed and a previous result of calculation of the quantity of energy to be consumed, as they are given by the energy consumption calculator 13.

In other words, the optimizer 14 stores therein a quantity of energy to be consumed, as it is calculated current time by the energy consumption calculator 13. Then, first (at the step 470), the optimizer 14 compares the current calculated quantity of energy to be consumed with a previous calculated and stored quantity of energy to be consumed, as it was calculated for a somewhat different running condition of the pump system 9, and determines whether or not the current calculated quantity of energy to be consumed is decreased from the previous calculated quantity of energy to be consumed.

Here, if the current calculated quantity of energy to be consumed is not determined as being decreased from the previous calculated quantity of energy to be consumed ("NO" at the step 470), the optimizer 14 operates (at a step 475) to still somewhat change a running condition of the pump system 9 involving a set of contents including the number of pumps 9*a* to be driven as well as a running output (as power consumption) of electric motors 9*b* to be operated to drive the pumps 9*a* . Further, the optimizer 14 operates (at the step 450) to control the energy consumption calculator 13 to again calculate a quantity of energy to be consumed as necessary for the changed running condition of the pump system 9, to execute subsequent processes.

On the other hand, when the current calculated quantity of energy to be consumed is determined as being decreased from the previous calculated quantity of energy to be consumed ("YES" at the step 470), the optimizer 14 operates (at a step 480) to subtract the previous calculated quantity of energy to be consumed from the current calculated quantity of energy to be consumed, to further determine whether or not the decrement is small enough.

Here, if the decrement from the previous calculated quantity of energy to be consumed is not determined as being small enough ("NO" at the step 480), the optimizer 14 operates (at the step 475) to again somewhat change the running condition of the pump system 9, before going again to the process at the step 450 to execute subsequent processes, like operations after the determination of "NO" at the step 470.

On the contrary, when the current calculated quantity of energy to be consumed is determined as being decreased from the previous calculated quantity of energy to be consumed ("YES" at the step 470) and the decrement after a subtraction of the previous calculated quantity of energy to be consumed from the current calculated quantity of energy to be consumed is determined as being small enough ("YES" at the step 480), the optimizer 14 operates (at a step 485) to take the running condition of the pump system 9 making the current calculated quantity of energy to be consumed, as a target value to be given to the pump system running controller 15.

(6) Running the Pump System 9 Depending on a Target Value (At the Step 495):

The pump system running controller 15 thus has an optimal running condition of the pump system 9, such as that making a minimal quantity of energy to be consumed, as it is given as a target value from the optimizer 14 through a process at the step 485 or the step 490. Then, the pump system running controller 15 operates (at the step 495) to select and control pumps 9*a* as well as electric motors 9*b* to drive the pumps 9*a* , depending on the target value.

(7) Determining if the Prescribed Prediction Cycle T1 is Elapsed (At a Step 500):

After that, the optimizer 14 operates (at the step 500) to determine whether or not the prescribed prediction cycle T1 is elapsed. When the prescribed prediction cycle T1 is elapsed ("YES" at the step 500), the process flow goes again to the process at the step 420, to repeat the sequence of processes at the step 420 through the step 500.

As will be seen from the foregoing, according to the example 1 , there is provided a pump driver for rolling lines adapted to repeat a sequence of processes at the above-noted steps 420 to 500 for each prescribed prediction cycle T1. By doing so, it can implement, within the prescribed prediction target period T2, predicting usages of cooling water used at the ROT 4, as well as running conditions of the pump system, including correcting a predicted running condition, as a constraint condition is unmet, and gradually changing a predicted running condition of the pump system, to have an optimal running condition of the pump system, such as that requiring a minimal quantity of energy to be consumed, to set up as a target value, for use to control a running of the pump system 9.

By doing so, the pump driver for rolling lines according to the example 1 is adapted to implement well-efficient operating constituent elements of the pump system 9, such as pumps 9*a* and electric motors 9*b* operable to drive the pumps 9*a* , meeting a prescribed constraint condition of a rolling line.

As a result, the rolling line is enabled to directly promote an energy saving at the pump system 9, as well as a cost saving, allowing for a reduced environmental load of the rolling line.

Example of Method of Predicting Running Condition of Pump System 9

Description is now made of an example of method of predicting a running condition of the pump system 9 at the running condition predictor 121, with reference to drawings.

Figure 5:
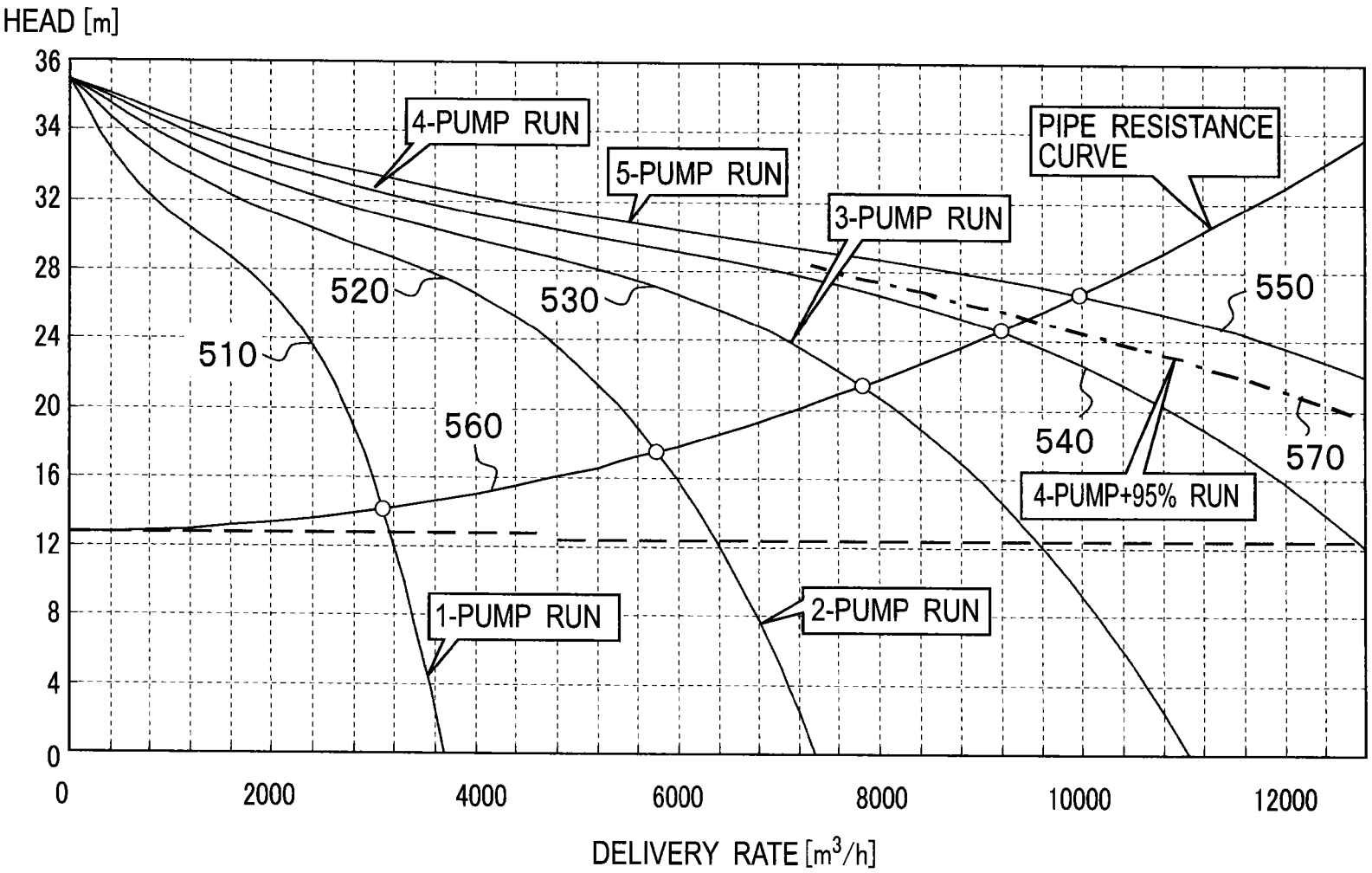
FIG. 5 is an explanatory diagram showing an example of relationship between a pipe resistance curve and pump characteristic curves taken for numbers of driven pumps.

FIG. 5 shows in an explanatory diagram a combination of characteristic curves each describing a relationship between a delivery rate $Q_{OPP}$ [$m^3$/h] of pump(s) 9*a* and a head [m] of the pump(s) 9*a* for anyone of 1-pump to 5-pump parallel runs among pumps 9*a* , and a pipe resistance curve of a pipeline (un-depicted) connected to the pumps 9*a*.

In FIG. 5, the horizontal axis represents a delivery rate $Q_{OPP}$ [$m^3$/h] of pump(s) 9*a* , and the vertical axis represents a head [m] of the pump(s) 9*a*.

For any number of pump(s) 9*a* used in a run, there is a working point defined as a point of intersection between a pipe resistance curve 560 and one of characteristic curves 510, 520, 530, 540, 550 describing a 1-pump, a 2-pump, . . . , and a 5-pump run, respectively.

For instance, for a combination of four pumps 9*a* used in a run, as shown in FIG. 5 there is taken an intersection point between the pipe resistance curve 560 and a characteristic curve 540 for a 4-pump run, which defines a working point that has a delivery rate $Q_{OPP}$ [$m^3$/h] of approximately 9,200 [$m^3$/h], and a head of approximately 25 [m].

For any pump 9*a* used, there is a driving motor 9*b* , which may be inverter-fed to drive, permitting a continuous change to be made in the delivery rate as well as in the head along the pipe resistance curve. For instance, assume a run using four pumps 9*a* plus a fifth pump 9*a* that is solely inverter-fed driven at a 95% output. And, as shown in FIG. 5, the pipe resistance curve 560 intersects a characteristic curve 570 describing a 4-pump+95% run, at a point defining a working point that has a delivery rate of approximately 9,600 [$m^3$/h], and a head of approximately 26 [m].

Such being the case, for any parallel run using pumps 9*a* , the pipe resistance curve 560 can serve to determine a combination of a delivery rate $Q_{OPP}$ [$m^3$/h] of the pumps 9*a* and a head [m] of the pumps 9*a*.

Figure 6:
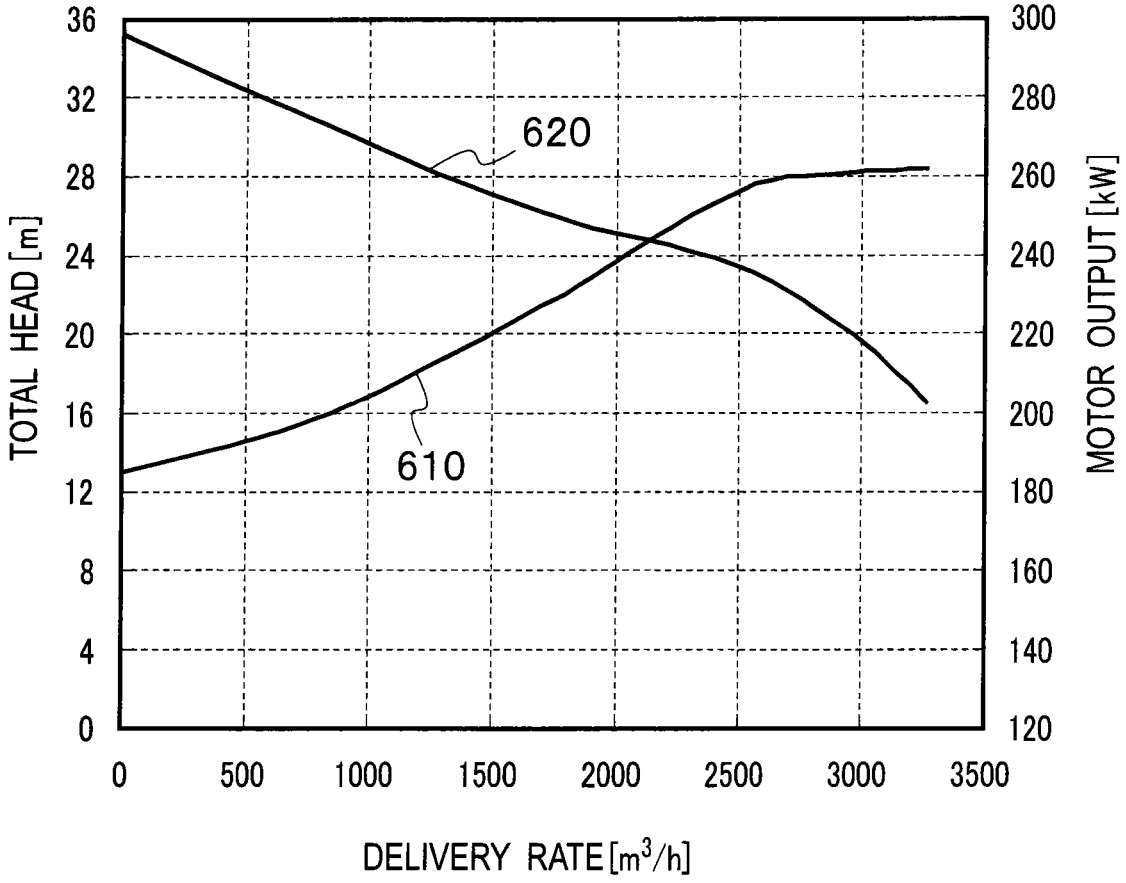
FIG. 6 is an explanatory diagram showing an example of relationship between a pump characteristic and a motor output taken for a single driven pump.

FIG. 6 shows in an explanatory diagram a relationship between a pump characteristic of one pump 9*a* and an output of an electric motor 9*b* to drive the pump 9*a*.

FIG. 6 has a horizontal axis representing a delivery rate $Q_{OPP}$ [$m^3$/h] of the pump 9*a,* and a vertical axis representing a total head [m] of the pump 9*a* , to describe a total head vs. delivery rate curve 620 combined with a motor output vs. delivery rate curve 610.

When given a delivery rate $Q_{OPP}$ [$m^3$/h] to be borne per one pump 9*a* , one can trace the motor output vs. delivery rate curve 610 to determine an output [kW] at an electric motor 9*b* used to drive that, as is apparent from FIG. 6.

After that, as the output of the electric motor 9*b* is given, it is possible to determine an output of an inverter, as well as a voltage input to the inverter. It is noted that when given an output of an electric motor 9*b* free from inverter-fed driving, one can determine a voltage input to the electric motor 9*b*.

For instance, assume using four pumps 9*a* for a delivery rate of approximately 9,200 [$m^3$/h] at a head of approximately 25 [m]. And, the delivery rate $Q_{OPP}$ [$m^3$/h] to be borne per one pump 9*a* can be given, such that 9,200 [$m^3$/h]÷4 [pumps]=2, 300 [$m^3$/h].

Referring to FIG. 6, since the delivery rate to be borne per one pump 9*a* has a value of 2,300 [$m^3$/h], the motor output vs. delivery rate curve 610 can be traced to find a value of approximately 252 [kW] as an output of an electric motor 9*b* assumed to be free from inverter-fed driving. Also, the total head vs. delivery rate curve 620 can be traced to find a value of approximately 24 [m] as a total head [m] per one pump 9*a* at the delivery rate [$m^3$/h] of 2,300 [$m^3$/h].

Such being the case, when given a delivery rate $Q_{OPP}$ [$m^3$/h] to be borne by one pump 9*a* , there can be determined a total head [m] of that pump 9*a* , and an output of an electric motor 9*b* diving one pump 9*a* . Also, when given a total head [m] of one pump 9*a* , there can be determined a delivery rate $Q_{OPP}$ [$m^3$/h] to be borne by one pump 9*a* , and an output of an electric motor 9*b* diving one pump 9*a* . Further, when given an output of an electric motor 9*b* diving one pump 9*a* , there can be determined a delivery rate $Q_{OPP}$ [$m^3$/h] to be borne by one pump 9*a,* and a total head [m] of that pump 9*a*.

To this point, there is a set of matters given as fixed, as shown in FIG. 2 including a head H [m] from the cooling water pit 7*b* to the ROT service tank 6*b* , encompassing pipe diameters and the like in a pipeline (un-depicted) extending from the cooling water pit 7*b* to the ROT service tank 6*b* . Therefore, the running condition predictor 121 is operable to predict, for each prescribed prediction cycle T1, a running condition of the pump system 9 compliant with diagrams of relationships between the pipe resistance curve and pump characteristic curves such as those shown in FIG. 5, as well as diagrams of relationships between pump characteristics and motor outputs such as those shown in FIG. 6. The running condition of the pump system 9 may involve contents about what number of pumps 9*a* should be used to make a certain run, including sub-contents such as those of whether the pumps 9*a* are connected in series or in parallel, and how much does an output of electric motors 9*b* amount

Example of Change Made in Prediction of Number of Driven Pumps 9*a* for Each Prescribed Prediction Cycle T1

The running condition predictor 121 is operable, for each prescribed prediction cycle T1, to change a prediction of the number of pumps 9*a* to be driven in compliance with diagrams of relationships between the pipe resistance curve and pump characteristic curves (for a 1-pump to a 5-pump run) such as those shown in FIG. 5, as well as diagrams of relationships between pump characteristics and motor outputs such as those shown in FIG. 6. In this respect, description is now made of an example, with reference to drawings.

Figure 7:
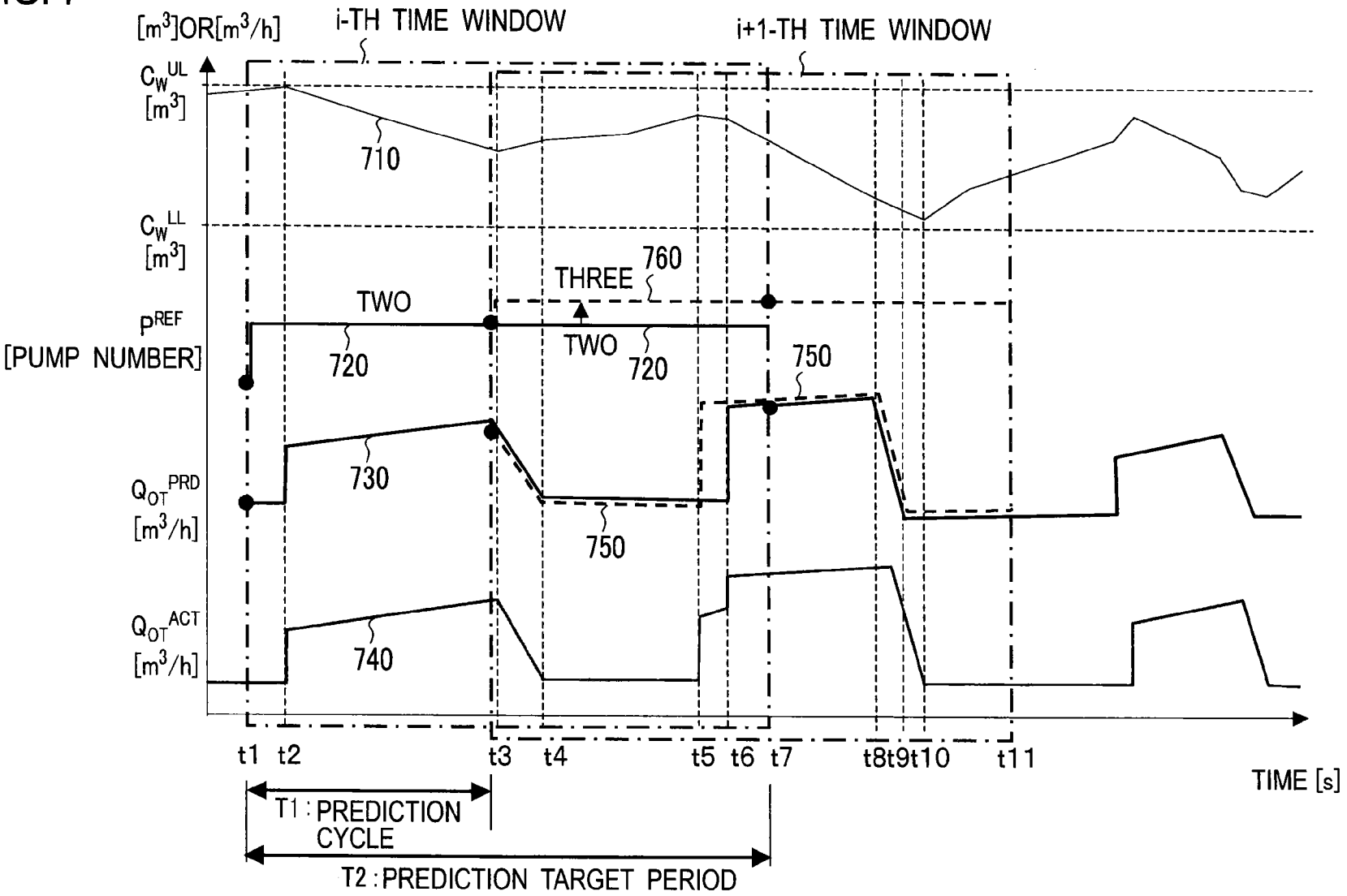
FIG. 7 is an explanatory diagram showing an example of control using the water injection controller in the cooling line according to the example 1 of embodiment

FIG. 7 shows in an explanatory diagram an example of change made by the running condition predictor 121 in a prediction of the number of driven pumps 9*a* for each prescribed prediction cycle t1, along circulation of cooling water at the ROT 4 shown in FIG. 2.

FIG. 7 has a horizontal axis representing a time [s], and a vertical axis representing:

(i) An upper limit value $C_W^{UL}$ [$m^3$] to the value of stored volume $C_W$ [$m^3$] of the ROT service tank 6*b;*

(ii) A lower limit value $C_W^{LL}$ [$m^3$] of stored volume $C_W$ [$m^3$] of the ROT service tank 6*b;*

(iii) A command value of a running condition of the pump system 9 (as a value $P^{REF}$ [pump number] commanding the number of pumps 9*a* to be driven);

(iv) A predictive value $Q_{OT}^{PRD}$ [$m^3$/h] of the delivery rate $Q_{OT}$ [$m^3$/h] from the ROT service tank 6*b;* and (v) An actual value $Q_{OT}^{ACT}$ [$m^3$/h] of the delivery rate $Q_{OT}$ [$m^3$/h] from the ROT service tank 6*b*.

FIG. 7 includes a combination of a polygonal curve 710, a polygonal curve 720, a polygonal curve 730, and a polygonal curve 740. The polygonal curve 710 indicates a variation in the value of stored volume $C_W$ [$m^3$] of the ROT service tank 6*b* . The polygonal curve 720 indicates a variation in the command value of a running condition of the pump system 9 (as the value $P^{REF}$ [pump number] commanding the number of pumps 9*a* to be driven). The polygonal curve 730 indicates a variation in the predictive value $Q_{OT}^{PRD}$ [$m^3$/h] of the delivery rate $Q_{OT}$ [$m^3$/h] from the ROT service tank 6*b* . The polygonal curve 740 indicates a variation in the actual value $Q_{OT}^{ACT}$ [$m^3$/h] of the delivery rate $Q_{OT}$ [$m^3$/h] from the ROT service tank 6*b*.

The optimizer 14 gives a command value (as a target value) of a running condition of the pump system 9, as an instruction to the pump system running controller 15. This is presented in the above-noted item (iii) as a value $P^{REF}$ [pump number] commanding the number of pumps 9*a* to be driven, for the sake of convenience in description. However, it may well include an output or the like of electric motors 9*b* driving the pumps 9*a*.

Further, in the above-noted item (iv), there is presented a predictive value $Q_{OT}^{PRD}$ [$m^3$/h] of the delivery rate $Q_{OT}$ [$m^3$/h] from the ROT service tank 6*b* , which is a value the running condition predictor 121 predicts for each prescribed prediction cycle T1 in the prescribed prediction target period T2.

Further, in the above-noted item (v), there is presented an actual value $Q_{OT}^{ACT}$ [m$^3$/h] of the delivery rate $Q_{OT}$ [m$^3$/h] from the ROT service tank 6*b* , which is a delivery rate $Q_{OT}$ [m$^3$/h] from the ROT service tank 6*b* that the temperature controller 100 is controlling to operate.

Further, FIG. 7 includes a combination of an i-th time window and an i+1-th time window. The i-th time window is an interval of time between a time point t1 and a time point t7, which defines a prescribed prediction target period T2 involving a prediction cycle T1 starting at the time point t1. The i+1-th time window is an interval of time between a time point t3 and a time point t11, which defines a prescribed prediction target period T2 involving a prediction cycle T1 starting at the time point t3. It is noted that in FIG. 7 the prescribed prediction target periods T2 have durations nearly double those of the prescribed prediction cycles T1, respectively.

Description is now made of operations of this controller, with reference to FIG. 7. The polygonal curve 710 shows the stored volume $C_W$ [m$^3$] of the ROT service tank 6*b* being decreased at an interval between a time point t2 and the time point t3. This is because of an operation of the temperature controller 100 causing the actual value $Q_{OT}^{ACT}$ [m$^3$/h] of the delivery rate $Q_{OT}$ [m$^3$/h] from the ROT service tank 6*b* to increase as shown by the polygonal curve 720, thereby cooling a rolling material. It is noted that, as shown by the polygonal curve 730, also the predictive value $Q_{OT}^{PRD}$ [m$^3$/h] of the delivery rate $Q_{OT}$ [m$^3$/h] the cooling water usage predictor 11 has predicted is increased in accordance with the actual value $Q_{OT}^{ACT}$ [m$^3$/h] of the delivery rate $Q_{OT}$ [m$^3$/h].

Further, FIG. 7 shows an interval between the time point t3 and a time point t5, as an interval of time to be elapsed after an end of the cooling of the rolling material until a subsequent rolling material comes up. At this interval, as shown by the polygonal curve 740, the actual value $Q_{OT}^{ACT}$ [m$^3$/h] of the delivery rate $Q_{OT}$ [m$^3$/h] from the ROT service tank 6*b* is decreased. In accordance with this delivery rate $Q_{OT}$ [m$^3$/h], also the predictive value $Q_{OT}^{PRD}$ [m$^3$/h] of the delivery rate $Q_{OT}$ [m$^3$/h] the cooling water usage predictor 11 has predicted is decreased, as shown by the polygonal curve 730.

In other words, in FIG. 7, when the polygonal curve 710 shows the value of stored volume $C_W$ [m$^3$] of the ROT service tank 6*b* being decreased, meaning that cooling water is supplied from the ROT service tank 6*b* to the ROT 4, the polygonal curve 730 shows the actual value $Q_{OT}^{ACT}$ [m$^3$/h] of the delivery rate $Q_{OT}$ [m$^3$/h] from the ROT service tank 6*b* the temperature controller 100 is operating, as being increased In accordance therewith, also the predictive value $Q_{OT}^{PRD}$ [m$^3$/h] of the delivery rate $Q_{OT}$ [m$^3$/h] from the ROT service tank 6*b* the running condition predictor 121 has predicted is increased, as shown by the polygonal curve 740. When the value of stored volume $C_W$ [m$^3$] of the ROT service tank 6*b* is increased, the actual value $Q_{OT}$ACT [m$^3$/h] of the delivery rate $Q_{OT}$ [m$^3$/h] from the ROT service tank 6*b* as well as the predictive value $Q_{OT}^{PRD}$ [m$^3$/h] thereof is decreased, accordingly.

Therefore, in the i-th time window between the time points t1 and t7, the optimizer 14 takes such predictive values $Q_{OT}^{PRD}$ [m$^3$/h] of the delivery rate $Q_{OT}$ [m$^3$/h] from the ROT service tank 6*b* the running condition predictor 121 has predicted, as a basis to predict a command value $P^{REF}$ [pump number] of the number of pumps 9*a* to be driven, as a content of a running condition of the pump system 9. For instance, assume this is predicted as two.

In due course, the prescribed prediction cycle T1 having started at the time point t1 is elapsed, reaching the time point t3, when a timing of prediction for the the i+1-th time window comes up. Then, like the course of prediction in the i-th time window, the running condition predictor 121 operates to predict predictive values $Q_{OT}^{PRD}$ [m$^3$/h] of the delivery rate $Q_{OT}$ [m$^3$/h] from the ROT service tank 6*b* , depending on actual values $Q_{OT}^{ACT}$ [m$^3$/h] of the delivery rate $Q_{OT}$ [m$^3$/h] from the ROT service tank 6*b* the temperature controller 100 is operating.

On this occasion, for instance, the rolling may proceed earlier, needing an earlier cooling at the ROT 4, whereby the temperature controller 100 may operate to cause the actual value $Q_{OT}^{ACT}$ [m$^3$/h] of the delivery rate $Q_{OT}$ [m$^3$/h] from the ROT service tank 6*b* to be suddenly increased by a timing at the time point t5, as shown by the polygonal curve 740. This course is now assumed.

In the i-th time window being an i-th prediction target period T2, the running condition predictor 121 operated to predict predictive values $Q_{OT}^{PRD}$ [m$^3$/h] of the delivery rate $Q_{OT}$ [m$^3$/h] from the ROT service tank 6*b* as shown by the polygonal curve 730 described by solid lines. However, in the i+1-th time window in the assumed course, the running condition predictor 121 receives operational information input from the temperature controller 100 with changed contents including a used water quantity at the ROT 4 as well as its time-dependent variation, and operates to predict as shown by a polygonal curve 750 described by dashed lines, in accordance with suddenly increased actual values $Q_{OT}^{ACT}$ [m$^3$/h] of the delivery rate $Q_{OT}$ [m$^3$/h] from the ROT service tank 6*b*.

In other words, in the i-th time window as the i-th prediction target period T2, the running condition predictor 121 operated to predict predictive values $Q_{OT}^{PRD}$ [m$^3$/h] of the delivery rate $Q_{OT}$ [m$^3$/h] from the ROT service tank 6*b* , to increase from a time point t6 as shown by the polygonal curve 730 described by solid lines. However, in the i+1-th time window, the running condition predictor 121 operates to change the prediction, to increase from the time point t5 as shown by the polygonal curve 750 described by dashed lines, in accordance with suddenly increased actual values $Q_{OT}^{ACT}$ [m$^3$/h] of the delivery rate $Q_{OT}$ [m$^3$/h] from the ROT service tank 6*b*.

In this regard, the optimizer 14 operated by a timing at the time point t1 to predict the number of pumps 9*a* to be driven, to be two in the i-th time window as shown by the polygonal curve 720 described by solid lines, on the basis of predictive values $Q_{OT}^{PRD}$ [m$^3$/h] of the delivery rate $Q_{OT}$ [m$^3$/h] from the ROT service tank 6*b* the running condition predictor 121 predicted. However, in the assumed course, the optimizer 14 operates by a timing at the time point t3 to predict the number of pumps 9*a* to be driven, to be three in the i+1-th time window as shown by a polygonal curve 760 described by dashed lines, so that it has a changed target value.

By doing so, the pump system running controller 15 is adapted in the i+1-th time window to control a running of the pump system 9 in accordance with a target value of a running condition of the pump system 9, such as the number of pumps 9*a* to be driven being three.

It is noted that, as shown in FIG. 2, there is a combination of a lower limit value $C_W^{LL}$ [m$^3$] and an upper limit value $C_W^{UL}$ [m$^3$] provided to the stored volume $C_W$ [m$^3$] of the ROT service tank 6*b* . The stored volume $C_W$ [m$^3$] of the ROT service tank 6*b* is kept from exceeding the upper limit value $C_W^{UL}$ [m$^3$], by provision of an overflow mechanism, that is, potential development of an overflow rate $Q_{OVF}$ [m$^3$/h].

Such variables have relations in between, which can be expressed by an expression 1 below $$C_W(t)=\int\{Q_{IT}(t)-Q_{OT}(t)-Q_{OVF}(t)\}dt+C_W(0) \quad \text{(Expression 1).}$$

It is noted that in the expression 1 above, $C_W(0)$ denotes an initial value of the stored volume $C_W$ [m$^3$] of the ROT service tank 6*b* , and the legend (t) indicates that the variable is a function of time t, i.e., a variable that varies with time t The optimizer 14 is made to implement predicting a balance of cooling water about the ROT service tank 6*b* , to control a running of the pump system 9, minimizing energy consumption at electric motors 9*b* , as described.

In this matter, if the optimizer 14 has a very long target period for determining a minimal quantity of energy to be consumed, it will take a very long calculation time to find a minimal consumption of energy.

Therefore, the optimizer 14 is adapted to minimize energy consumption within a prediction target period T2 in which the cooling water usage predictor 11 as well as the constrained running condition predictor 12 is operable to make a prediction for each prescribed prediction cycle T1.

By doing so, the optimizer 14 is operable to shift the prediction target period T2 in steps of the prescribed prediction cycle T1, thereby coping with time-dependent variations.

Such being the case, the example 1 includes the cooling water usage predictor 11, the running condition predictor 121, the running condition corrector 122, and the energy consumption calculator 13 cooperating as follows. The cooling water usage predictor 11 is operable to predict, for each prescribed prediction cycle T1, a usage of cooling water in a prescribed prediction target period T2, including contents such as a water delivery amount from the ROT service tank 6*b* or a water inflow amount to the ROT service tank 6*b* , and a time-dependent variation thereof. The running condition predictor 121 is operable to take predictive values such as those of the water delivery amount from or the water inflow amount to the ROT service tank 6*b* , and the time-dependent variation thereof, as a basis to predict a running condition of the pump system 9. The running condition corrector 122 is operable to correct the running condition of the pump system 9 when a prescribed constraint condition is unmet, to meet the constraint condition. The energy consumption calculator 13 is operable to take the running condition of the pump system 9, as a basis to calculate a quantity of energy to be consumed Then, the optimizer 14 is operable to somewhat change the predicted running condition of the pump system 9, to have the energy consumption calculator 13 calculate quantities of energy to be consumed under different running conditions of the pump system 9, and select a running condition of the pump system 9 requiring an optimal, e.g. minimal, quantity of energy to be consumed, to send as a target value to the pump system running controller 15.

For instance, assume the required head H from the cooling water pit 7*b* to the ROT service tank 6*b* (refer to FIG. 2) and the inflow rate $Q_{IT}$ [m$^3$/h] to the ROT service tank 6*b* or the delivery rates $Q_{OPP}$ [m$^3$/h] of the pumps 9*a* (refer to FIG. 2) as being constant. And, as will be seen from the discussion with reference to FIG. 5, the number of pumps 9*a* required to be driven can be determined as a discrete amount, not continuous, so the optimizer 14 is operable to determine a necessary number of pumps 9*a* to be driven, as a content of a running condition of the pump system 9.

Further, as will be seen from the discussion with reference to FIG. 6, when given a delivery rate $Q_{OPP}$ [m$^3$/h] (refer to FIG. 2) of pumps 9*a* , there can be determined an output of electric motors 9*b* . Therefore, the energy consumption calculator 13 is operable to determine a quantity of energy to be consumed (as an electric energy) in the prescribed prediction target period T2.

In the description with reference to FIG. 7, as a running condition of the pump system 9, the number of pumps 9*a* to be driven or electric motors 9*b* to be operated to drive pumps 9*a* is changed. However, this is for the sake of convenience in description. It is noted that electric motors 9*b* may be converter-fed driven. In such a case, the electric motors 9*b* have a continuously variable output, permitting the inflow rate $Q_{IT}^{REF}$ [m3/h] to the ROT service tank 6*b* to be continuously varied.

In this case, the optimizer 14 may iterate calculations to determine quantities of energy to be consumed under various running conditions of the pump system 9 in a heuristic manner. Further, there may be applied a known Newton-Raphson method, steepest descent method, or the like to determine an output of electric motors 9*b* operated to drive pumps 9*a* minimizing the quantity of energy to be consumed.

Therefore, according to the example 1 , the water injection controller 10 for rolling lines includes the cooling water usage predictor 11, the running condition predictor 121, the running condition corrector 122, the energy consumption calculator 13, the optimizer 14, and the pump system running controller 15 cooperating as follows. The cooling water usage predictor 11 is operable to predict, for each prescribed prediction cycle T1, a usage of cooling water in a prescribed prediction target period T2. The running condition predictor 121 is operable to take the predicted usage of cooling water as a basis to predict a running condition of the pump system 9 as necessary in the prediction target period T2. The running condition corrector 122 is operable to correct the predicted running condition of the pump system 9 when a constraint condition to the rolling line is unmet. The energy consumption calculator 13 is operable to take the running condition of the pump system 9 through the running condition corrector 122 as a basis to calculate a quantity of energy to be consumed at the pump system 9 in the prediction target period T2. The optimizer 14 is operable to change the predicted running condition of the pump system 9 to have calculated quantities of energy to be consumed, to determine therefrom an optimal quantity of energy to be consumed. The pump system running controller 15 is operable to control the pump system 9 having as a target value therefore a running condition of the pump system 9 making the optimal quantity of energy to be consumed the optimizer 14 has determined. Accordingly, the water injection controller 10 is adapted to implement well-efficient operating the pump system 9, securing the constraint condition to the rolling line, for each prescribed prediction cycle T1.

This permits an energy saving as well as a cost saving at the pump system 9 in the rolling line to be directly promoted, allowing for a reduced environmental load of the rolling line.

Figure 8:
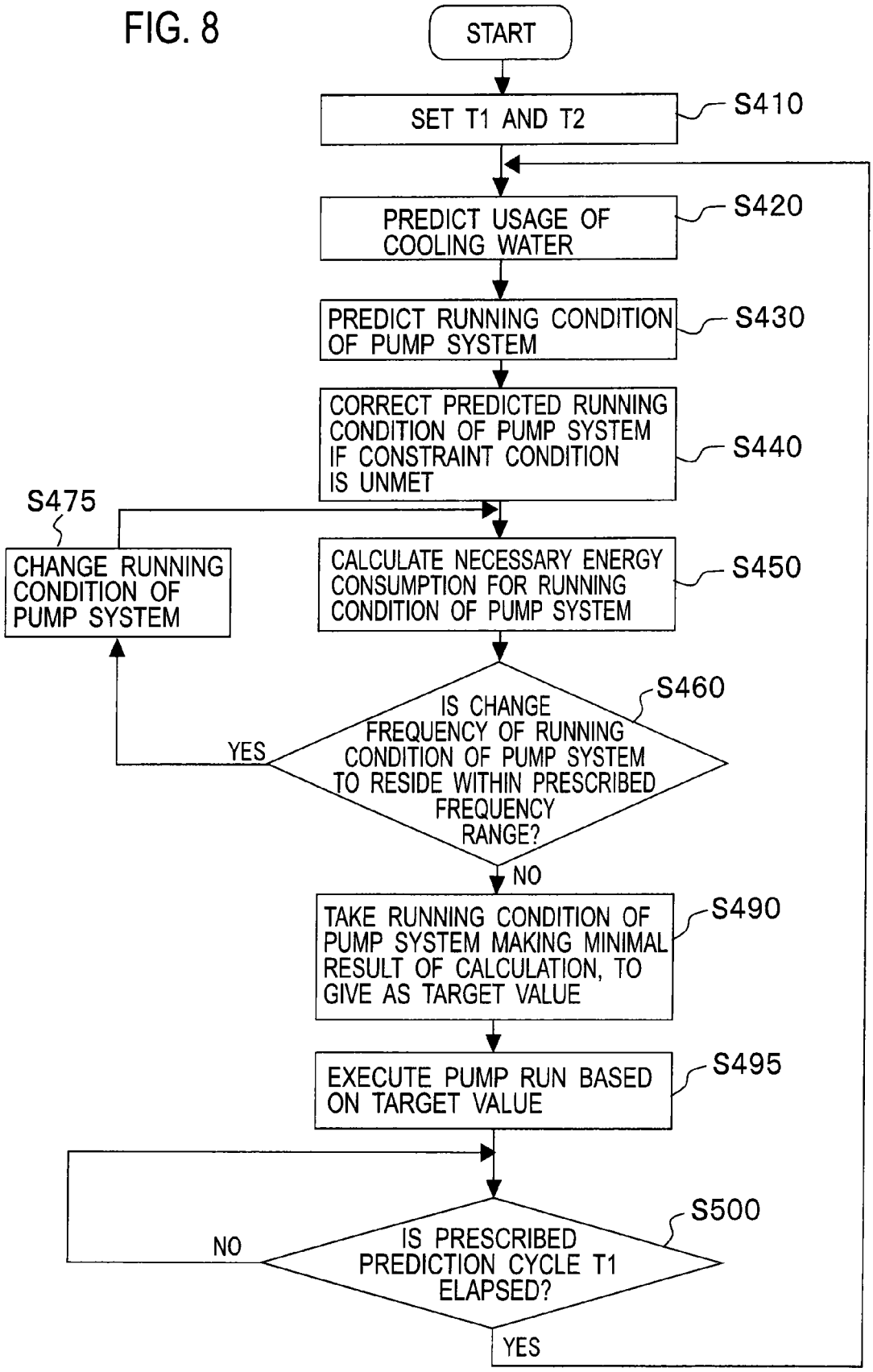
FIG. 8 is a flowchart showing another example of sequence of operations of the water injection controller in the cooling line according to the example 1 of embodiment.

The example 1 follows the flowchart shown in FIGS. 4A and 4B to operate as described. This flowchart has its part shown in FIG. 4B, in which processes at the steps 470, 480, and 485 may be skipped for instance to provide a flowchart shown in FIG. 8. It is noted that there may well be a sequence of operations following the flowchart shown in FIG. 8.

Example 2

Description is now made of a water injection controller 20 for rolling lines according to an example 2 of embodiment.

According to the example 2 of embodiment, the water injection controller 20 for rolling lines can serve to use cooling water for cooling a rolling material transferred to an ROT 4, in a situation in which, as to the use of cooling water, such pieces of direct operational information as involving a used water quantity and its time-dependent variation are unavailable at a temperature controller 100. The water injection controller 20 is thus adapted to acquire therefrom pieces of attribute information (as indirect information) on a rolling material to be cooled, which may include product dimensions such as a thickness and a width, a steel type, a class, a length of the material, a speed of the material, a pattern of water injection such as whether to cool at a front stage or at a rear stage, and a control pattern such as whether to make a feedback control or not. The water injection controller 20 is made as an implement for taking such pieces of attribute information (as indirect information) as a basis to predict, for each prescribed prediction cycle T1, usages of cooling water as well as running conditions of a pump system in a prescribed prediction target period T2, to set up an optimal running condition of the pump system, as a target for a drive.

It is noted that relative to the water injection controller 10 for rolling lines according to the example 1 , the water injection controller 20 for rolling lines according to the example 2 is different simply in the method of prediction at a cooling water usage predictor. Therefore, description will be simply made of the cooling water usage predictor according to the example 2.

Figure 9:
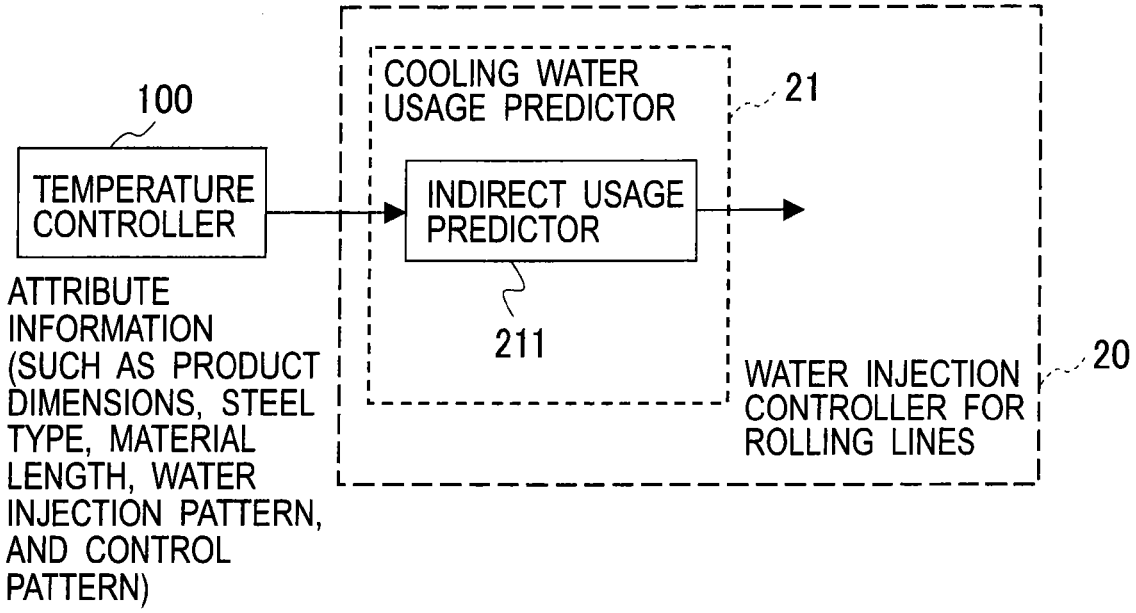
FIG. 9 is a block diagram showing an example of configuration of a cooling water usage predictor of a water injection controller in a cooling line according to an example 2 of embodiment.

FIG. 9 shows in a block diagram an example of configuration of a cooling water usage predictor 21 according to the example 2.

According to the example 2 , as shown in FIG. 9, the cooling water wage predictor 21 includes an indirect usage predictor 211.

The indirect usage predictor 211 is made as an implement to be used in a situation in which, as information pertinent to cooling a rolling material, such pieces of operational information as involving a used water quantity of cooling water at the ROT 4 and its time-dependent variation are unavailable at the temperature controller 100.

To this point, the temperature controller 100 has pieces of attribute information (as indirect information) on a rolling material to be transferred to cool on the ROT 4, including at least product dimensions such as a thickness and a width, a steel type, a class, a length of the material, a speed of the material, a pattern of water injection such as whether to cool at a front stage or at a rear stage, and a control pattern such as whether to make a feedback control or not The indirect usage predictor 211 is operable to acquire those pieces of attribute information as information pertinent to cooling the rolling material, and predict, for each prescribed prediction cycle T1, a usage of cooling water, that is, a used water quantity of cooling water, its time-dependent variation, and the like in a prescribed prediction target period T2.

More specifically, the indirect usage predictor 211 acquires such pieces of attribute information from the temperature controller 100, while it has similar pieces of attribute information on past cooled rolling materials, as well as such pieces of information as involving actual used water quantities and water delivery amounts of cooling water from the ROT service tank 6*b* as they were predicted for past cooled rolling materials. The indirect usage predictor 211 uses such information to predict therefrom what amounts of water are required to be used to inject to the ROT service tank 6*b* , such as those for a rolling material next to come to be transferred to cool on the ROT 4, and a rolling material to come after next to be transferred to cool on the ROT 4.

Figure 10:
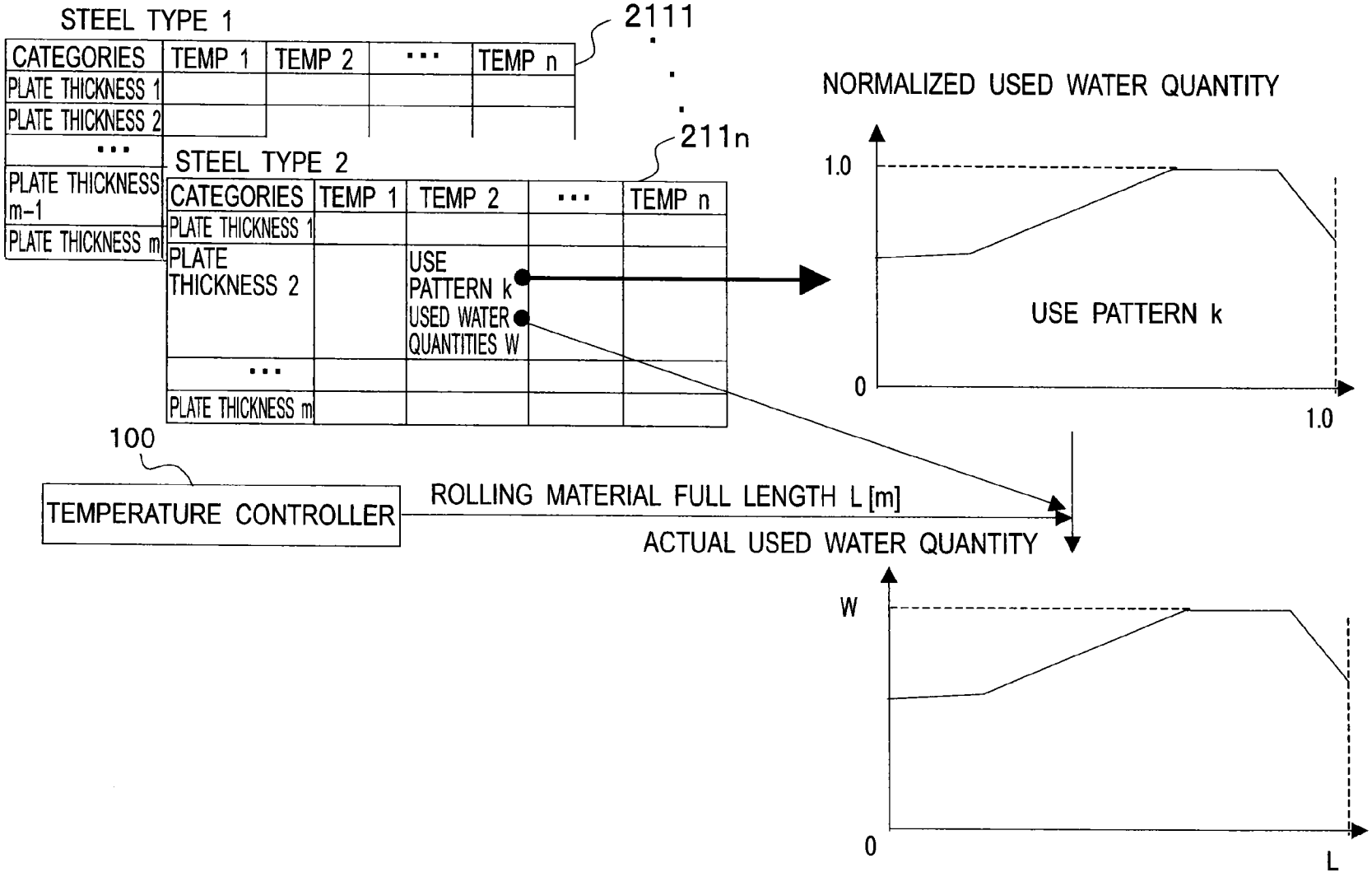
FIG. 10 is an explanatory diagram showing an example of prediction method at the cooling water usage predictor of the water injection controller in the cooling line according to the example 2 of embodiment.

Therefore, as shown in FIG. 10 for example, the indirect usage predictor 211 has reference tables 2111 to 211n (n is an integer) sorted for each of steel types such as those of past cooled rolling materials, and categorized by pieces of attribute information (as indirect information) such as product plate thickness, full length, plate width, targeted coiling temperature, and rolling material speed (un-depicted). In each reference table 221n, each categorized item serves to store therein a usage of cooling water involving e.g. a use pattern k normalized by a full length L [m] of a rolling material and a used water quantity W [m3], as well as used water quantities W.

At the indirect usage predictor 211, as shown in FIG. 10 for example, the use pattern k is approximated in a polygonal form defined by a horizontal axis normalized to 1.0 by a full length L [m] of a rolling material, and a vertical axis normalized to 1.0 by a maximal used water quantity W.

Then, the indirect usage predictor 211 acquires from the temperature controller 100 such pieces of attribute information as involving a full length, a plate thickness, a plate width, a targeted coiling temperature, and a rolling material speed of a rolling material next to come to be transferred to the ROT 4, and collates with reference tables 221n stored therein, to take out a used water quantity W [$m^3$] and a normalized use pattern k from a categorized item matching with attribute information of the rolling material next to come, while referring also to the full length L [m] of the rolling material next to come, to thereby predict for each prescribed prediction cycle T1 an actual usage of cooling water in the prescribed prediction target period T2.

Namely, the indirect usage predictor 211 has information on the full length L [m] of the rolling material given from the temperature controller 100, and can take advantage of the chance of referring to the normalized use pattern k, to convert the horizontal axis to the full length L [m] of the rolling material. The vertical axis has a normalized value, which can be multiplied by the used water quantity W [$m^3$] put in the categorized item of the normalized use pattern k, to know an absolute value of the used water quantity.

Therefore, like the water injection controller 10 for rolling lines in the example 1 , the water injection controller 20 for rolling lines in the example 2 is adapted to implement well-efficient operating a pump system 9, securing a constraint condition to a rolling line. This permits an energy saving as well as a cost saving at the pump system 9 in the rolling line to be directly promoted, allowing for a reduced environmental load of the rolling line.

In particular, according to the example 2 , the water injection controller 20 for rolling lines includes the indirect usage predictor 211, which is adapted to predict, for each prescribed prediction cycle T1, a usage of cooling water to be used in a prescribed prediction target period T2, based on attribute information (as indirect information) taken as information pertinent to cooling a rolling material, involving product dimensions such as a thickness and a width, a steel type, a class, and a material length of the rolling material, a control pattern, and the like. Therefore, the indirect usage predictor 211 can take the attribute information as a basis to predict a usage of cooling water to be used in the prescribed prediction target period T2, even in a situation in which such pieces of direct operational information (as direct information) as involving a used water quantity of cooling water and its time-dependent variation are unavailable.

Example 3

Description is now made of a water injection controller 30 for rolling lines according to an example 3 of embodiment.

The water injection controller 30 for rolling lines according to the example 3 of embodiment is made as an implement for learning values of used water quantities in categorized items of reference tables 221n stored in an indirect usage predictor 311 provided in the above-noted water injection controller 20 for rolling lines according to the example 2 . The water injection controller 30 thus assumes a configuration of the above-noted water injection controller 20 for rolling lines according to the example 2 . Therefore, description will be simply made of a cooling water usage predictor according to the example 3.

Figure 11:
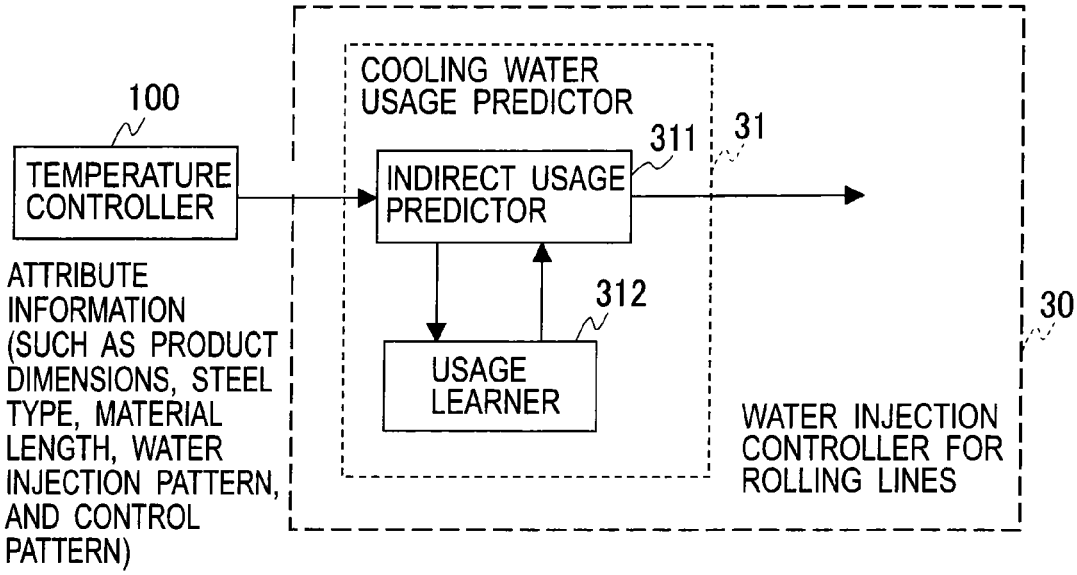
FIG. 11 is a block diagram showing an example of configuration of a cooling water usage predictor of a water injection controller in a cooling line according to an example 3 of embodiment.

FIG. 11 shows in a block diagram an example of configuration of a cooling water usage predictor 31 according to the example 3.

As shown in FIG. 11, the cooling water usage predictor 31 according to the example 3 includes a combination of an indirect usage predictor 311 identical to the indirect usage predictor 211 according to the example 2 , and a usage learner 312. This is a configuration of the indirect usage predictor 211 according to the example 2 provided with an additional function to learn used water quantities.

Namely, like the indirect usage predictor 211 according to the example 2 , the indirect usage predictor 311 is operative, in a situation in which as information pertinent to cooling a rolling material such pieces of operational information as involving a used water quantity at an ROT 4 and its time-dependent variation are unavailable from a temperature controller 100, to take a combination of pieces of attribute information from the temperature controller 100, similar pieces of attribute information on past cooled rolling materials, and such pieces of information as involving actual used water quantities and water delivery amounts of cooling water as they have been predicted for past cooled rolling materials, as a basis to predict therefrom what amounts of water are required to be used to inject to an ROT service tank 6*b* , for a rolling material next to come to be transferred to cool on the ROT 4.

In this situation, according to the example 3 , the usage learner 312 is operative to input from the temperature controller 100 actual values of usages of cooling water used for past cooled rolling materials, to learn, and set up as values of used water quantities W in categorized items in associated reference tables 211 n in the indirect usage predictor 311.

Namely, the usage learner 312 inputs from the temperature controller 100 a used water quantity for a past cooled rolling material, and a combination of plate thickness, plate width, steel type, and targeted coiling temperature of the rolling material, as shown in FIG. 10. Then, the usage learner 312 operates, at a categorized item matching with the combination of plate thickness, plate width, steel type, and targeted coiling temperature of the rolling material, to learn the used water quantity by e.g. using an expression 2 below, such that:

$$\begin{aligned}&(\text{learned used water quantity}) = \\ &\quad K\cdot(\text{actual used water quantity}) + \\ &\quad (1-K)\cdot(\text{stored value at the categorized} \\ &\qquad \text{item in a reference table before learn}),\end{aligned} \qquad \text{(Expression 2)}$$

where K is a learning gain.

The usage learner 312 has the used water quantity learned by using the expression 2, as a value of used water quantity W to be stored at the same categorized item, and updates the reference table 211n . Also with respect to a normalized use pattern k in the reference table 221n, the usage learner 312 may learn and update coordinates on vertical and horizontal axes of each apex of a polygonal curve, using the actual value of used water quantity, like the expression 2.

Such being the case, in this example of embodiment, the usage learner 312 is operative to input actual used water quantities W as well as use patterns k or the like of past cooled rolling materials, as they are acquired from the temperature controller 100, to learn, and update a used water quantity as well as a use pattern k in a respective categorized item in a reference table 221n stored in the indirect usage predictor 311.

Therefore, like the water injection controllers 10 and 20 for rolling lines in the examples 1 and 2 , the water injection controller 30 for rolling lines in the example 3 is adapted to implement well-efficient operating a pump system 9, securing a constraint condition to a rolling line. This permits an energy saving as well as a cost saving at the pump system 9 in the rolling line to be directly promoted.

Further, like the water injection controller 20 for rolling lines according to the example 2 , the water injection controller 30 for rolling lines according to the example 3 includes the indirect usage predictor 211, which is adapted to predict, for each prescribed prediction cycle T1, a usage of cooling water to be used in a prescribed prediction target period T2, based on attribute information of rolling material. Therefore, the indirect usage predictor can predict a usage of cooling water to be used for a current cooling rolling material in the prescribed prediction target period T2, even in a situation in which such pieces of direct operational information (as direct information) as involving a used water quantity of cooling water and its time-dependent variation are unavailable.

In particular, according to the example 3 , the water injection controller 30 for rolling lines has the usage learner 312 provided to the cooling water usage predictor 31. The usage learner 312 is adapted to learn a usage of cooling water such as an actual used water quantity as well as a use pattern acquired from the temperature controller 100 for a past cooled rolling material, to set up as a value of a used water quantity or such at a categorized item in an associated reference table in the indirect usage predictor 311. As the learning advances, the indirect usage predictor 311 is to have the more accurate used water quantity, as well as use pattern or such, set up at the categorized item in the associated reference table. This permits the more accurate prediction of a used water quantity, even in a situation in which such pieces of direct operational information (as direct information) as involving a used water quantity of cooling water and its time-dependent variation are unavailable from the temperature controller 100, so such pieces of attribute information that the indirect usage predictor 211 has acquired (as indirect information) from the temperature controller 100 as well as reference tables are based on to predict, for each prescribed prediction cycle T1, a usage of cooling water such as a used water quantity and its time-dependent variation in the prescribed prediction target period T2.

Example 4

Description is now made of a water injection controller for rolling lines according to another example of embodiment. It is noted that this example 4 is different from the water injection controllers for rolling lines in the described examples 1 to 3 simply in a prediction method at a cooling water usage predictor. For this reason, description of the example 4 is simply made of the cooling water usage predictor.

Figure 12:
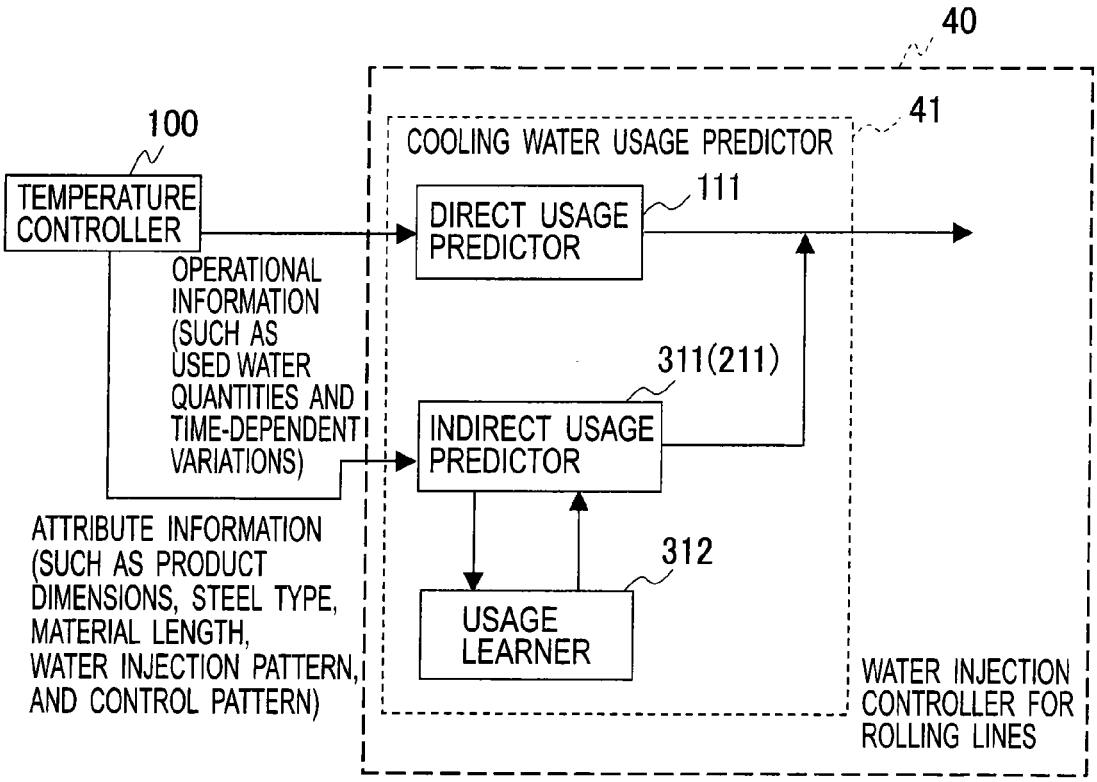
FIG. 12 is a block diagram showing an example of configuration of a cooling water usage predictor of a water injection controller in a cooling line according to an example 4 of embodiment.

FIG. 12 shows in a block diagram an example of configuration of a cooling water usage predictor 41 according to the example 4.

As shown in FIG. 12, the cooling water usage predictor 41 according to the example 4 is made as an implement including the direct usage predictor 111 of the cooling water usage predictor 11 shown in FIG. 3 according to the example 4 , and the indirect usage predictor 311 and the usage learner 312 shown in FIG. 11 according to the example 3 . It is noted that the indirect image predictor 311 shown in FIG. 12 may perform a prediction of usage without using the usage learner 312, like the indirect usage predictor 211 shown in FIG. 9 according to the example 2.

In the cooling water usage predictor 41 according to this example of embodiment, when such pieces of operational information (as direct information) as involving a used water quantity for a current cooling rolling material and its time-dependent variation are available from a temperature controller 100, the direct usage predictor 111 is operable to take such pieces of operational information (as direct information) as a basis to predict, for each prescribed prediction cycle T1, a usage of cooling water in a prescribed prediction target period T2, like the example 1.

On the contrary, in a situation in which such pieces of operational information (as direct information) as involving a used water quantity for a current cooling rolling material and its time-dependent variation are unavailable from the temperature controller 100, the indirect usage predictor 211 is operable like the example 2 or 3 , to acquire from the temperature controller 100 or the like such pieces of attribute information (as indirect information) as involving product dimensions such as a thickness and a width, a steel type, a class, and a material length of the rolling material, and a control pattern, and take such attribute information (as indirect information) as a basis to predict, for each prescribed prediction cycle T1, a usage of cooling water to be used in the prescribed prediction target period T2, like the example 1.

Therefore, like the water injection controllers for rolling lines in the examples 1 to 3, the water injection controller for rolling lines in the example 4 is adapted to implement well-efficient operating a pump system 9, securing a constraint condition to a rolling line. This permits an energy saving as well as a cost saving at the pump system 9 in the rolling line to be directly promoted, allowing for a reduced environmental load of the rolling line.

In particular, in the water injection controller 40 for rolling lines according to the example 4 , the cooling water usage predictor 41 has the direct Image predictor 111 according to the example 1 , and the indirect usage predictor 311 and the usage learner 312 according to the example 3 . The water injection controller 40 is thus adaptively operable to predict, for each prescribed prediction cycle T1, a usage of cooling water to be used in the prescribed prediction target period T2, whether in a situation in which such pieces of operational information (as direct information) as involving a used water quantity for a current cooling rolling material and its time-dependent variation are available from the temperature controller 100 or the like, or in a situation in which those pieces of operational information (as direct information) are unavailable, but simply such pieces of attribute information (as indirect information) as involving product dimensions such as a thickness and a width, a steel type, a class, and a material length of the rolling material, and a control pattern are available.

Example 5

Description is now made of a water injection controller 50 for rolling lines according to an example 5 of embodiment.

It is very difficult to predict an accurate usage of cooling water. For instance, there may be a rolling material transferred onto a ROT 4 with a deviated timing, or an occasional state of a temperature controller 100 making a feedback control for a temperature control of a coiler 5, causing the usage of cooling water to vary. As a result, there may be errors developed between predictive usage values and actual values. Such errors may cause an ROT service tank 6*b* to have a stored volume $C_W$ [m$^3$] lower than its lower limit value $C_W^{LL}$ [m$^3$], whereby the rolling line may undergo an unmet constraint condition.

To this point, the water injection controller for rolling lines according to the example 5 of embodiment is made as an implement to cope with a changed quantity of state of the rolling line undergoing an unmet constraint condition such as due to a stored volume $C_W$ [m$^3$] of the ROT service tank 6*b* getting lower than its lower limit value $C_W^{LL}$ [m$^3$], by an adaptation to enable a direct correction to a target value of running condition of a pump system 9, as it is set by an optimizer 14 to a pump system running controller 15.

Figure 13:
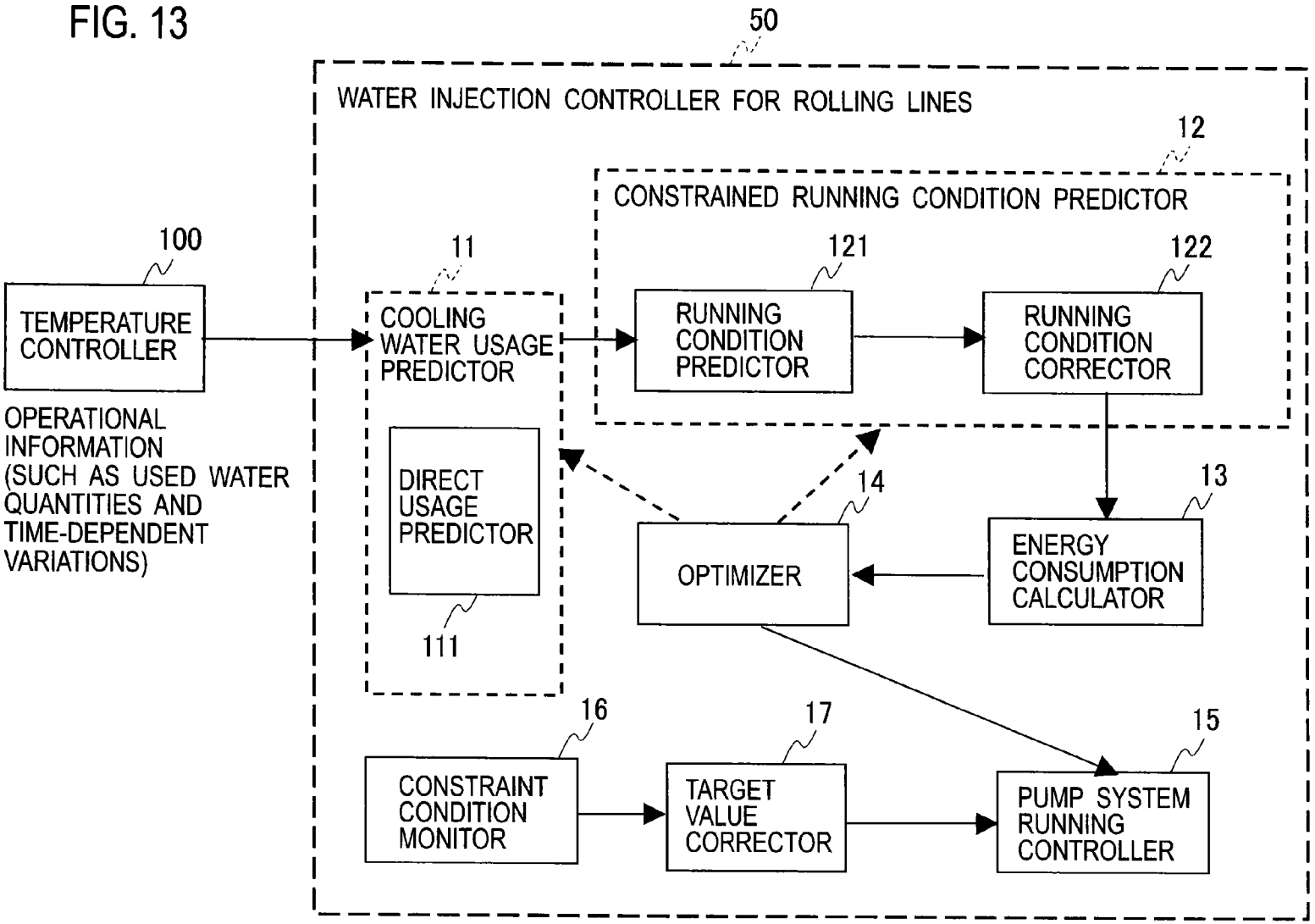
FIG. 13 is a block diagram showing an example of configuration of a water injection controller in a cooling line according to an example 5 of embodiment.

FIG. 13 shows in a block diagram an example of configuration of the water injection controller 50 for rolling lines according to the example 5 of embodiment As shown in FIG. 13, the water injection controller 50 for rolling lines according to the example 5 has a configuration of the water injection controller 10 for rolling lines shown in FIG. 3 according to the example 1 , as it is provided with an additional combination of a constraint condition monitor 16 and a target value corrector 17. That is, the other components are identical to those of the water injection controller 10 for rolling lines shown in FIG. 3 according to the example 1 , so they are designated by identical reference signs, omitting redundancy. Description will be made of the constraint condition monitor 16 and the target value corrector 17. It is noted that the water injection controller 50 for rolling lines according to the example 5 may well have the configuration of a water injection controller for rolling lines according to any one of the examples 2 to 4 , as it is provided with an additional combination of the constraint condition monitor 16 and the target value corrector 17.

Here, the constraint condition monitor 16 is operable to real time detect a quantity of state associated with a constraint condition to this rolling line. The constraint condition monitor 16 is adapted for a monitoring to check for a constraint condition unmet by any state quantity. For instance, the constraint condition monitor 16 may detect a stored volume $C_W$ [m$^3$] of the ROT service tank 6*b* , checking for its state getting lower than the lower limit value $CW^{LL}$ [m$^3$]. In that case, the stored volume $C_W$ [m$^3$] of the ROT service tank 6*b* to be kept from getting lower than the lower limit value $C_W^{LL}$ [m$^3$] constitutes a constraint condition.

The target value corrector 17 is made as an implement operable when given a Result of monitoring from the constraint condition monitor 16 informing of a constraint condition unmet by a quantity of state being monitored, to promptly make a correction of a target value of running condition of the pump system 9, directly to the pump system running controller 15, to thereby make the monitored state quantity meet the constraint condition.

In this respect, in the example 5 , the pump system running controller 15 is adapted not simply to follow a running condition of the pump system 9 set up as a target value by the optimizer 14 to control a running of the pump system 9, but also to follow a target value directly corrected by the target value corrector 17 to control the running of the pump system 9.

Here, the water injection controller 50 for rolling lines according to the example 5 is adapted to accommodate a correction by giving high priority to a target value of running condition of the pump system 9 corrected by the target value corrector 17, relative to a target value calculated by the optimizer 14, from the viewpoint of having a prescribed constraint condition to the rolling line met as fast as possible.

Description is now made of a specific example in this matter.

Figure 14:
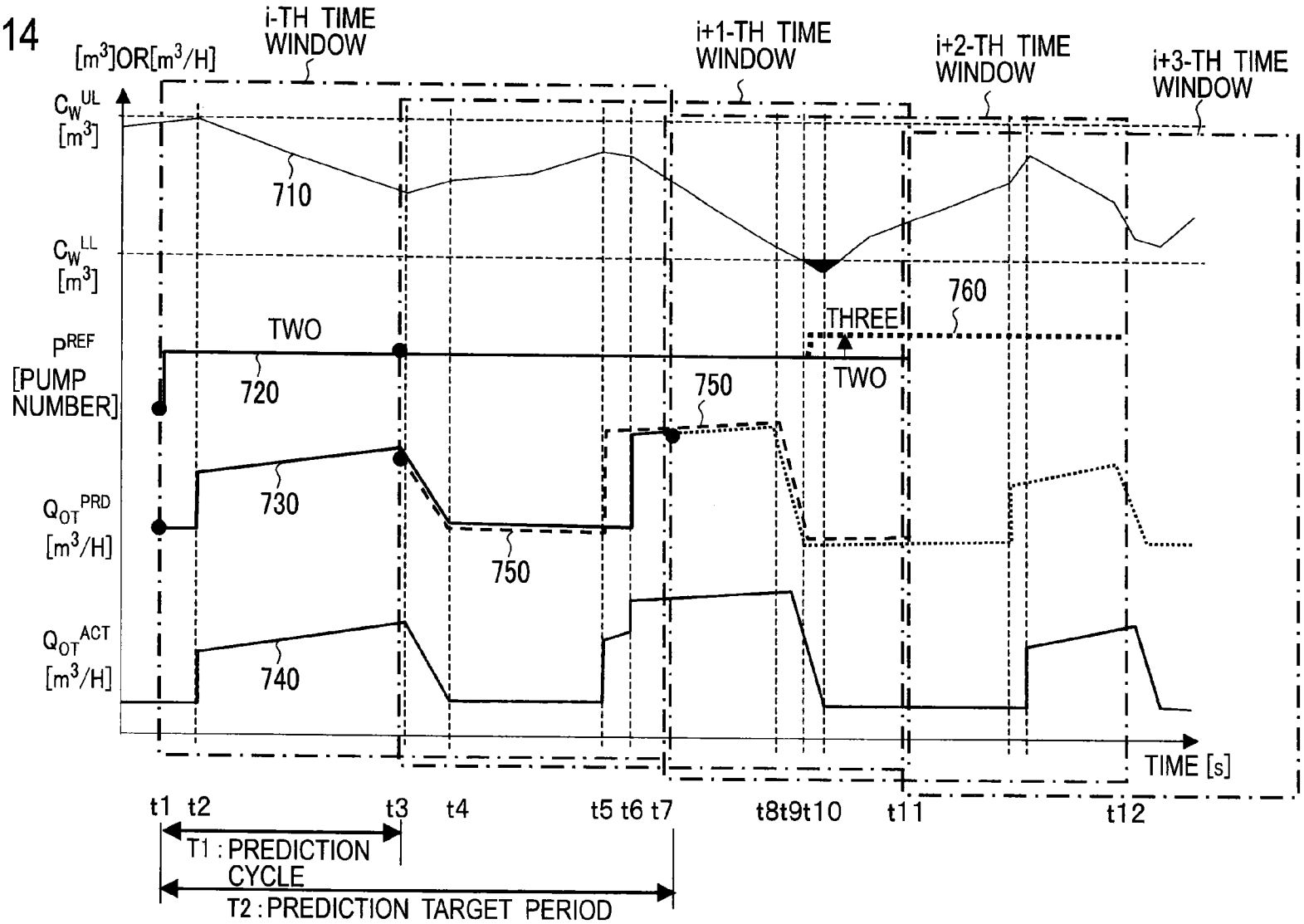
FIG. 14 is an explanatory diagram showing an example of correction of a target value at the water injection controller in the cooling line according to the example 5 of embodiment.

FIG. 14 shows in an explanatory diagram an example of correction made of a target value by the target value corrector 18 in the water injection controller 50 for rolling lines according to the example 5.

FIG. 14 shows a polygonal curve 710 describing a stored volume $C_W$ [$m^3$] of an ROT service tank 6*b* , which is now assumed as getting lower than a lower limit value $C_W^{LL}$ [$m^3$] at a time point t9.

This example includes the constraint condition monitor 16 real time detecting State quantities associated with contents of a constraint condition such as the stored volume $C_W$[$m^3$] of the ROT service tank 6*b* , checking e.g. for a state of the stored volume $C_W$[$m^3$]getting lower than the lower limit value $C_W^{LL}$ [$m^3$]. Therefore, at the time point t9 when the stored volume $C_W$[$m^3$] of the ROT service tank 6*b* gets lower than the lower limit value $C_W^{LL}$ [$m^3$], a result of this monitoring is real time output to the target value corrector 17.

The target value corrector 17 operates in response to the monitoring result from the constraint condition monitor 16, to have the constraint condition met by the state quantity being monitored, that is, in this case, to make the stored volume $C_W$ [$m^3$] of the ROT service tank 6*b* get the lower limit value $C_W^{LL}$ [$m^3$] or higher. This is done by promptly making a correction of a target value directly to the pump system running controller 15. The target value is a content of the running condition of the pump system 9 that may be the number of pumps 9*a* to be driven or a running output (as power consumption) of electric motors 9*a* operated to drive the pumps 9*a*.

FIG. 14 shows an i-th time window extending between time points t1 and t7, an i+1-th time window extending between time points t3 and t11, and an i+2-th time window extending between time points t7 and t12. In the i-th time window, as well as in the i+1-th time window, a target value $P^{REF}$ [pump number] for the i+2-th time window is set by the optimizer 14 to the pump system running controller 15. It is now assumed that, as shown by a polygonal curve 720, the optimizer 14 has determined the target value $P^{REF}$ [pump number] should be two as being optimal.

However, in this example, a target value corrected by the target value corrector 17 has high priority to a target value set by the optimizer 14. Therefore, if the stored volume $C_W$[$m^3$] of the ROT service tank 6*b* is decreased under the lower limit value $C_W^{LL}$ [$m^3$] at the time point t9, the target value corrector 17 corrects the number of pumps 9*a* to be driven from two to three in a command for correction of the target value $P^{REF}$ [pump number], so that, even in the i+1 -th time window between time points t3 and t11, as shown by a polygonal curve 730, the stored volume $C_W$ [$m^3$] gets the lower limit value $C_W^{LL}$ [$m^3$] or higher at the time point t9 or promptly thereafter.

The stored volume $C_W$ [$m^3$] of the ROT service tank 6*b* shown by the polygonal curve 710 is thereby continuously increased, promptly getting the lower limit value $C_W^{LL}$ [$m^3$] or higher.

It is noted that the water injection controllers 10 to 40 in the examples 1 to 4 have neither the constraint condition monitor 16 nor the target value corrector 17. There is a used water quantity as well as a running condition predicted every prediction cycle T1, which disables making a prompt correction of target value $P^{REF}$ [pump number]. In the examples 1 to 4 , the target value $P^{REF}$ [pump number] is not corrective until a prediction cycle T1 comes up on or after e.g. the time point 9 where a stored volume $C_W$ [$m^3$] of the ROT service tank 6*b* lower than the lower limit value $C_W^{LL}$ [$m^3$] can affect, for instance at the time point t11 that is the timing for a prediction cycle T1 of an i+4-th time window.

To the contrary, in the water injection controller in the example 5 , the target value $P^{REF}$ [pump number] is promptly corrected at the time point t9. This is more rapid than the water injection controllers 10 to 40 in the examples 1 to 4 in which the target value $P^{REF}$ [pump number] is not corrective until a subsequent prediction cycle T1 comes up on or after the time point 9. It can be seen that in the example of FIG. 11 the running of the pump system 9 is controlled to meet the constraint condition earlier by a time fraction of approximately (t9-t11), to increase the stored volume $C_W$ [$m^3$] of the ROT service tank 6*b*.

By that, in the water injection controller 50 for rolling lines in the example 5 , assuming the situation in FIG. 11, the stored volume $C_W$ [$m^3$] of the ROT service tank 6*b* is to be increased earlier by the time fraction of approximately (t9-t11), whereby the state of the stored volume $C_W$ [$m^3$] of the ROT service tank 6*b* being decreased under the lower limit value $C_W^{LL}$ [$m^3$], by which the restraint condition is unmet, can be rapidly restored, thus allowing this water injection controller to be more stable than the water injection controllers 10 to 40 for rolling lines in the examples 1 to 4.

Therefore, like the water injection controllers 10 to 40 for rolling lines in the examples 1 to 4 , the water injection controller 50 for rolling lines in the example 5 is adapted to implement well-efficient operating a pump system 9, securing a constraint condition to a rolling line. This permits an energy saving as well as a cost saving at the pump system 9 in the rolling line to be directly promoted, allowing for a reduced environmental load of the rolling line.

In particular, the water injection controller 50 for rolling lines in the example 5 has a configuration of any one of the water injection controllers 10 to 40 for rolling lines in the examples 1 to 4 , as it is provided with an additional combination of the constraint condition monitor 16 and the target value corrector 17, whereby it is adapted even after the optimizer 14 has set a target value to the pump system running controller 15, to give priority that is high relative to that target value to a target value corrected by the combination of the constraint condition monitor 16 and the target value corrector 17. This allows for the more stable water injection controller rapidly abiding by a constraint condition.

The examples 1 to 5 described have included examples of configuration of water injection controllers for rolling lines according to embodiments herein hardware-like illustrated as shown in e.g. FIG. 3 and FIG. 13. It however is noted that embodiments herein are not limited to them. Water injection controllers for rolling lines according to embodiments herein may well be configured with a CPU and a memory or the like having stored therein a water injection control program for implementing operations similar to those in the examples described, to provide a computer system or a control system adapted for a software-like implementation.

Further, the examples 1 to 5 have been described about a hot rolling mill. It however is noted that water injection controllers, water injection control methods, and water injection control programs according to embodiments herein are not limited to then, and are likewise applicable also to other mode of rolling plants that have similar water injection equipment.

INDUSTRIAL APPLICABILITY

As will be seen from the foregoing, according to embodiments herein, there are water injection controllers, water injection control methods, and water injection control programs adapted to minimize required energy for running a pump system employed at a water injection facility of a rolling line, meeting constraints to controlling functions to have a secured product quality. This adaptation is accompanied by effects permitting an energy saving as well as a cost saving to be promoted, allowing for a reduced environmental load at the rolling line. All rolling lines can be targeted, encompassing hot sheet rolling lines as well as plate rolling lines and cold rolling lines, providing that they are of a type that uses cooling water stored in a tank for cooling a rolling material in the rolling line, collecting used cooling water to return to the tank by a pump system. Those rolling lines have their water injection controllers, water injection control methods, and water injection control programs, which can bask in enhanced chances of the industrial applicability.

REFERENCE SIGNS LIST

10, 20, 30, 40, and 50 . . . water injection controllers in cooling lines
11, 21, 31, and 41 . . . cooling water usage predictors
111 . . . a direct usage predictor
211 and 311 . . . indirect usage predictors
312 a usage learner
12 . . . a constrained running condition predictor
121 . . . a running condition predictor
122 . . . a running condition corrector
13 . . . an energy consumption calculator
14 . . . an optimizer
15 . . . a pump system running controller
16 . . . a constraint condition monitor
17 . . . a target value corrector
100 . . . a temperature controller

The invention claimed is:

1. A water injection controller for rolling lines adapted to use cooling water stored in a tank to cool a rolling material in a rolling line and collect used cooling water to return to the tank by a pump system, the water injection controller for rolling lines comprising:

a cooling water usage predictor configured to take information pertinent to cooling the rolling material as a basis to predict, for a respective prescribed prediction cycle T1, a usage of cooling water in a prescribed prediction target period T2;

a constrained running condition predictor configured to take the usage of cooling water predicted by the cooling water usage predictor as a basis to predict, for the respective prescribed prediction cycle T1, a running condition of the pump system in the prediction target period T2 meeting a prescribed constraint condition;

an energy consumption calculator configured to take the running condition of the pump system as a basis to calculate a quantity of energy to be consumed for an operation of the pump system in the prediction target period T2;

an optimizer configured to operate, for the respective prescribed prediction cycle T1, to change the running condition of the pump system predicted by the constrained running condition predictor, to give to the energy consumption calculator, to have the energy consumption calculator calculate a plurality of quantities of energy to be consumed, and determine an optimal quantity of energy to be consumed among the plurality of quantities of energy to be consumed that the energy consumption calculator has calculated; and a pump system running controller configured to control a running of the pump system having as a target value therefor a running condition of the pump system making the optimal quantity of energy to be consumed that the optimizer has determined.

2. The water injection controller for rolling lines according to claim 1, wherein the constrained running condition predictor comprises:

a running condition predictor configured to take the usage of cooling water predicted by the cooling water usage predictor as a basis to predict, for the respective prescribed prediction cycle T1, a running condition of the pump system in the prediction target period T2; and a running condition corrector configured to determine whether or not the prescribed constraint condition is met by the running condition of the pump system predicted by the running condition predictor, and operate simply when the constraint condition is unmet by the running condition of the pump system, to correct the running condition of the pump system to meet the constraint condition.

3. The water injection controller for rolling lines according to claim 1, further comprising:

a constraint condition monitor configured to monitor in real time a quantity of state of the rolling line pertinent to the prescribed constraint condition, and monitor whether or not the prescribed constraint condition is unmet by the quantity of state of the rolling line; and a target value corrector configured to operate when the constraint condition monitor has determined the prescribed constraint condition as being unmet by the quantity of state of the rolling line, to correct the target value of the pump system running controller to have a quantity of state of the rolling line residing within the prescribed constraint condition.

4. The water injection controller for rolling lines according to claim 1, wherein the cooling water usage predictor comprises a direct usage predictor configured to input operational information on a used water quantity and time-dependent variations of cooling water for a current cooling rolling material as information pertinent to cooling the rolling material, and take the operational information as a basis to predict, for a respective prescribed prediction cycle T1, a usage of cooling water in a prescribed prediction target period T2.

5. The water injection controller for rolling lines according to claim 1, wherein the cooling water usage predictor comprises an indirect usage predictor configured to store therein a reference table including information on attributes of past cooled rolling materials associated with usages for the past cooled rolling materials, input attribute information of a current cooling rolling material as information pertinent to cooling the rolling material, and take the attribute information as a basis to refer to the reference table and predict, for a respective prescribed prediction cycle T1, a usage of cooling water in a prescribed prediction target period T2.

6. The water injection controller for rolling lines according to claim 5, wherein the cooling water usage predictor further comprises a usage learner configured to input a usage of cooling water for a past cooled rolling material to perform a prescribed learning thereon, and use the usage after the learning to update a usage for the past cooled rolling material in the reference table stored in the indirect usage predictor, and the indirect usage predictor is configured to input attribute information of the current cooling rolling material as information pertinent to cooling the rolling material, and take the attribute information as a basis to refer to the reference table and predict, for a respective prescribed prediction cycle T1, a usage of cooling water in a prescribed prediction target period T2.

7. The water injection controller for rolling lines according to claim 1, wherein the cooling water usage predictor comprises:

a direct usage predictor configured to input operational information on a used water quantity and time-dependent variations of cooling water for a current cooling rolling material as information pertinent to cooling the rolling material, and take the operational information as a basis to predict, for a respective prescribed prediction cycle T1, a usage of cooling water in a prescribed prediction target period T2;

an indirect usage predictor configured to store therein a reference table including information on attributes of past cooled rolling materials associated with usages for the past cooled rolling materials, input attribute information of a current cooling rolling material as information pertinent to cooling the rolling material, and take the attribute information as a basis to refer to the reference table and predict, for a respective prescribed prediction cycle T1, a usage of cooling water in a prescribed prediction target period T2; and a usage learner configured to input a usage of cooling water for a past cooled rolling material to perform a prescribed learning thereon, and use the usage after the learning to update a usage for the past cooled rolling material in the reference table stored in the indirect usage predictor, and is configured to have the direct usage predictor or the indirect usage predictor predict a usage of cooling water in an adaptive manner depending on input information pertinent to cooling the rolling material.

8. The water injection controller for rolling lines according to claim 1, wherein the prescribed prediction cycle T1 and the prescribed prediction target period T2 have a relation in between such that T1≤T2.

9. The water injection controller for rolling lines according to claim 1, wherein the prescribed constraint condition comprises one or more of upper and lower limit values of a water level or a retained water quantity in the tank, a minimal value in number of running ones of pumps constituting the pump system, and a minimal value of an output of electric motors running to drive pumps.

10. A water injection control method for rolling lines adapted to use cooling water stored in a tank to cool a rolling material in a rolling line and collect used cooling water to return to the tank by a pump system, the water injection control method for rolling lines comprising:

a step of taking information pertinent to cooling the rolling material as a basis to predict, for a respective prescribed prediction cycle T1, a usage of cooling water in a prescribed prediction target period T2;

a step of taking the predicted usage of cooling water as a basis to predict, for the respective prescribed prediction cycle T1, a running condition of the pump system in the prediction target period T2 meeting a prescribed constraint condition;

a step of taking the predicted running condition of the pump system as a basis to calculate a quantity of energy to be consumed for an operation of the pump system in the prediction target period T2;

a step of operating, for the respective prescribed prediction cycle T1, to change the predicted running condition of the pump system, to calculate a plurality of quantities of energy to be consumed, and determining an optimal quantity of energy to be consumed among the plurality of calculated quantities of energy to be consumed; and a step of having a running condition of the pump system making the optimal quantity of energy to be consumed as a target value to drive the pump.

* * * * *